US005265015A

United States Patent [19]

Auzerais et al.

[11] Patent Number: 5,265,015

[45] Date of Patent: Nov. 23, 1993

[54] DETERMINING HORIZONTAL AND/OR VERTICAL PERMEABILITY OF AN EARTH FORMATION

[75] Inventors: Francois M. Auzerais; Elizabeth B. Dussan V., both of Ridgefield, Conn.

[73] Assignee: Schlumberger Technology Corporation, New York, N.Y.

[21] Appl. No.: 722,052

[22] Filed: Jun. 27, 1991

[51] Int. Cl.[5] ..... G06F 15/20; E21B 47/00

[52] U.S. Cl. ..... 364/421; 73/155

[58] Field of Search ..... 364/421-422; 73/152, 155

[56] References Cited

U.S. PATENT DOCUMENTS 3,780,575 12/1973 Urbanosky .
3,952,588 4/1976 Whitten .
4,742,459 5/1958 Lasseter .
4,890,487 1/1990 Dussan V. et al. .

OTHER PUBLICATIONS

E. B. Dussan V. et al., An Analysis of the Pressure Response of A Single-Probe Formation Tester, SPE Paper No. 16801, presented at the 62nd Annual Technical Conference and Exhibition of the Society of Petroleum Engineers (1987).

R. Eijpe et al., Geological Note: Mini-Permeameters for Consolidated Rock and Unconsolidated Sand, The American Association of Petroleum Geologists Bulletin, vol. 55, NO. 2, pp. 307-309 (1971).

C. McPhee, Proposed Mini-Permeameter Evaluation Report, Edinburgh Petroleum Equipment, Ltd., Edinburgh, Scotland (1987).

D. Goggin et al., *A Theoreticl and Experimental Analysis of Minipermeameter Response Including Gas Slippage and High Velocity Flow Effects*,m In Situ, 12(1&2)m pp. 79-116 (1988).

J. N. Goodier et al., Elasticity and Plasticity, John Wiley & Sons, Inc., pp. 29-35 (1958).

F. Auzerais et al., *Laboratory Characterization of Anisotropic Rocks*, SPE Paper No. 20602, presented at the 65th Annual Technical Conference and Exhibition of the Society of Petroleum Engineers, New Orleans, Sep. 23-26, 1990.

H. S. Carslaw et al., Conduction of Heat in Solids, Oxford Science Publication 91959).

*Primary Examiner*—Gail O. Hayes
*Attorney, Agent, or Firm*—Bruce D. Riter; Marc D. Foodman; Leonard W. Pojunas

[57] ABSTRACT

Fluid flow measurements are made in situ using a repeat formation tester with a modified probe aperture, or on rock samples using a mini-permeameter with a modified probe aperture. The modified probe aperture has an elongate cross-section, such as elliptic or rectangular. A first flow measurement is made with the longer dimension of the probe aperture in a first orientation (e.g., horizontal or vertical) with respect to the formation bedding planes. A second flow measurement is made with the probe aperture orthogonal to the first orientation, or with a probe aperture of non-elongate (e.g., circular) cross-section. Simultaneous equations relating values of known and measured quantities are solved to obtain estimates of local horizontal and/or vertical formation permeability.

57 Claims, 18 Drawing Sheets

| $M$ | $K_{H_1}$ | $K_{V_1}$ | $K_{H_2}$ | $K_{V_2}$ | $k_h/k_v$ |
|---|---|---|---|---|---|
| 1.0000 | 1.385 | 1.385 | 1.385 | 1.385 | 1 |
| 0.8838 | 1.540 | 0.7699 | 1.742 | 0.8711 | 2 |
| 0.8231 | 1.631 | 0.5438 | 1.982 | 0.6607 | 3 |
| 0.7832 | 1.697 | 0.4241 | 2.166 | 0.5415 | 4 |
| 0.7541 | 1.747 | 0.3495 | 2.317 | 0.4634 | 5 |
| 0.7314 | 1.789 | 0.2981 | 2.446 | 0.4076 | 6 |
| 0.7130 | 1.824 | 0.2606 | 2.558 | 0.3654 | 7 |
| 0.6977 | 1.854 | 0.2318 | 2.658 | 0.3322 | 8 |
| 0.6846 | 1.881 | 0.2090 | 2.748 | 0.3053 | 9 |
| 0.6732 | 1.905 | 0.1905 | 2.830 | 0.2830 | 10 |
| 0.6631 | 1.927 | 0.1752 | 2.906 | 0.2642 | 11 |
| 0.6542 | 1.947 | 0.1622 | 2.976 | 0.2480 | 12 |
| 0.6461 | 1.965 | 0.1512 | 3.041 | 0.2340 | 13 |
| 0.6388 | 1.982 | 0.1416 | 3.103 | 0.2216 | 14 |
| 0.6322 | 1.998 | 0.1332 | 3.160 | 0.2107 | 15 |
| 0.6260 | 2.013 | 0.1258 | 3.215 | 0.2009 | 16 |
| 0.6204 | 2.027 | 0.1192 | 3.267 | 0.1922 | 17 |
| 0.6151 | 2.040 | 0.1133 | 3.316 | 0.1842 | 18 |
| 0.6102 | 2.052 | 0.1080 | 3.363 | 0.1770 | 19 |
| 0.6057 | 2.064 | 0.1032 | 3.407 | 0.1704 | 20 |
| 0.6014 | 2.075 | 0.09880 | 3.450 | 0.1643 | 21 |
| 0.5974 | 2.086 | 0.09480 | 3.491 | 0.1587 | 22 |
| 0.5935 | 2.096 | 0.09112 | 3.531 | 0.1535 | 23 |
| 0.5899 | 2.105 | 0.08773 | 3.569 | 0.1487 | 24 |
| 0.5865 | 2.115 | 0.08459 | 3.606 | 0.1442 | 25 |
| | | | | | |
| 0.6732 | 1.905 | 0.1905 | 2.830 | 0.2830 | 10 |
| 0.6057 | 2.064 | 0.1032 | 3.407 | 0.1704 | 20 |
| 0.5718 | 2.157 | 0.07188 | 3.772 | 0.1257 | 30 |
| 0.5500 | 2.222 | 0.05556 | 4.041 | 0.1010 | 40 |
| 0.5342 | 2.274 | 0.04547 | 4.256 | 0.0851 | 50 |
| 0.5221 | 2.315 | 0.03859 | 4.435 | 0.0739 | 60 |
| 0.5124 | 2.351 | 0.03358 | 4.588 | 0.0655 | 70 |
| 0.5043 | 2.381 | 0.02977 | 4.722 | 0.0590 | 80 |
| 0.4974 | 2.408 | 0.02676 | 4.842 | 0.0538 | 90 |
| 0.4914 | 2.433 | 0.02433 | 4.950 | 0.0495 | 100 |

FIG. 10

| $M$ | $K_{H_1}$ | $K_{V_1}$ | $K_{H_2}$ | $K_{V_2}$ | $k_h/k_v$ |
|---|---|---|---|---|---|
| 1.0000 | 2.697 | 2.697 | 2.697 | 2.697 | 1 |
| 0.7939 | 2.853 | 1.427 | 3.594 | 1.797 | 2 |
| 0.6939 | 2.945 | 0.9815 | 4.244 | 1.145 | 3 |
| 0.6308 | 3.009 | 0.7523 | 4.771 | 1.193 | 4 |
| 0.5859 | 3.060 | 0.6119 | 5.222 | 1.004 | 5 |
| 0.5517 | 3.101 | 0.5168 | 5.620 | 0.9366 | 6 |
| 0.5244 | 3.135 | 0.4479 | 5.978 | 0.8540 | 7 |
| 0.5019 | 3.165 | 0.3957 | 6.306 | 0.7883 | 8 |
| 0.4829 | 3.192 | 0.3546 | 6.609 | 0.7344 | 9 |
| 0.4666 | 3.216 | 0.3216 | 6.892 | 0.6892 | 10 |
| 0.4523 | 3.237 | 0.2943 | 7.157 | 0.6507 | 11 |
| 0.4396 | 3.257 | 0.2714 | 7.408 | 0.6173 | 12 |
| 0.4283 | 3.275 | 0.2519 | 7.645 | 0.5881 | 13 |
| 0.4181 | 3.291 | 0.2351 | 7.872 | 0.5623 | 14 |
| 0.4089 | 3.307 | 0.2205 | 8.088 | 0.5392 | 15 |
| 0.4004 | 3.321 | 0.2076 | 8.295 | 0.5185 | 16 |
| 0.3926 | 3.335 | 0.1962 | 8.494 | 0.4997 | 17 |
| 0.3854 | 3.348 | 0.1860 | 8.686 | 0.4826 | 18 |
| 0.3787 | 3.360 | 0.1768 | 8.871 | 0.4669 | 19 |
| 0.3725 | 3.372 | 0.1686 | 9.050 | 0.4525 | 20 |
| 0.3667 | 3.383 | 0.1611 | 9.224 | 0.4392 | 21 |
| 0.3613 | 3.393 | 0.1542 | 9.392 | 0.4269 | 22 |
| 0.3561 | 3.403 | 0.1480 | 9.555 | 0.4154 | 23 |
| 0.3513 | 3.413 | 0.1422 | 9.714 | 0.4047 | 24 |
| 0.3467 | 3.422 | 0.1369 | 9.868 | 0.3947 | 25 |
| | | | | | |
| 0.4666 | 3.216 | 0.3216 | 6.892 | 0.6892 | 10 |
| 0.3725 | 3.372 | 0.1686 | 9.050 | 0.4525 | 20 |
| 0.3271 | 3.463 | 0.1154 | 10.59 | 0.3529 | 30 |
| 0.2985 | 3.528 | 0.08819 | 11.82 | 0.2954 | 40 |
| 0.2783 | 3.578 | 0.07156 | 12.86 | 0.2572 | 50 |
| 0.2628 | 3.619 | 0.06031 | 13.77 | 0.2295 | 60 |
| 0.2505 | 3.654 | 0.05219 | 14.58 | 0.2084 | 70 |
| 0.2404 | 3.684 | 0.04604 | 15.33 | 0.1916 | 80 |
| 0.2318 | 3.710 | 0.04122 | 16.01 | 0.1778 | 90 |
| 0.2244 | 3.734 | 0.03734 | 16.64 | 0.1664 | 100 |

FIG. 13

| $M$ | $K_{H_1}$ | $K_{V_1}$ | $K_{H_2}$ | $K_{V_2}$ | $k_h/k_v$ |
|---|---|---|---|---|---|
| 1.000 | 1.316 | 1.316 | 1.316 | 1.316 | 1 |
| 0.8871 | 1.467 | 0.7335 | 1.654 | 0.8268 | 2 |
| 0.8280 | 1.556 | 0.5187 | 1.880 | 0.6265 | 3 |
| 0.7890 | 1.620 | 0.4050 | 2.053 | 0.5133 | 4 |
| 0.7605 | 1.670 | 0.3339 | 2.195 | 0.4391 | 5 |
| 0.7383 | 1.710 | 0.2850 | 2.317 | 0.3861 | 6 |
| 0.7202 | 1.745 | 0.2492 | 2.423 | 0.3461 | 7 |
| 0.7051 | 1.775 | 0.2218 | 2.517 | 0.3146 | 8 |
| 0.6922 | 1.801 | 0.2001 | 2.602 | 0.2891 | 9 |
| 0.6810 | 1.825 | 0.1825 | 2.680 | 0.2680 | 10 |
| 0.6711 | 1.846 | 0.1678 | 2.751 | 0.2501 | 11 |
| 0.6623 | 1.866 | 0.1555 | 2.817 | 0.2348 | 12 |
| 0.6543 | 1.884 | 0.1449 | 2.879 | 0.2215 | 13 |
| 0.6471 | 1.900 | 0.1357 | 2.937 | 0.2098 | 14 |
| 0.6405 | 1.916 | 0.1277 | 2.991 | 0.1994 | 15 |
| 0.6345 | 1.931 | 0.1207 | 3.043 | 0.1902 | 16 |
| 0.6289 | 1.944 | 0.1144 | 3.092 | 0.1819 | 17 |
| 0.6237 | 1.957 | 0.1087 | 3.138 | 0.1743 | 18 |
| 0.6189 | 1.969 | 0.1037 | 3.182 | 0.1675 | 19 |
| 0.6143 | 1.981 | 0.09905 | 3.225 | 0.1612 | 20 |
| 0.6101 | 1.992 | 0.09486 | 3.265 | 0.1555 | 21 |
| 0.6061 | 2.003 | 0.09103 | 3.304 | 0.1502 | 22 |
| 0.6023 | 2.013 | 0.08751 | 3.342 | 0.1453 | 23 |
| 0.5987 | 2.022 | 0.08426 | 3.378 | 0.1407 | 24 |
| 0.5954 | 2.032 | 0.08126 | 3.412 | 0.1365 | 25 |
| | | | | | |
| 0.6810 | 1.825 | 0.1825 | 2.680 | 0.2680 | 10 |
| 0.6143 | 1.981 | 0.09905 | 3.225 | 0.1612 | 20 |
| 0.5807 | 2.073 | 0.06910 | 3.570 | 0.1190 | 30 |
| 0.5590 | 2.138 | 0.05345 | 3.825 | 0.09562 | 40 |
| 0.5433 | 2.189 | 0.04378 | 4.029 | 0.08057 | 50 |
| 0.5313 | 2.230 | 0.03717 | 4.198 | 0.06997 | 60 |
| 0.5215 | 2.265 | 0.03236 | 4.344 | 0.06206 | 70 |
| 0.5134 | 2.296 | 0.02870 | 4.472 | 0.05590 | 80 |
| 0.5065 | 2.323 | 0.02581 | 4.586 | 0.05095 | 90 |
| 0.5005 | 2.347 | 0.02347 | 4.689 | 0.04689 | 100 |

FIG.18

| $M$ | $K_{H_1}$ | $K_{V_1}$ | $K_{H_2}$ | $K_{V_2}$ | $k_h/k_v$ |
|---|---|---|---|---|---|
| 0.7222 | 1.000 | 1.0000 | 1.385 | 1.385 | 1 |
| 0.6775 | 1.180 | 0.5902 | 1.742 | 0.8711 | 2 |
| 0.6517 | 1.292 | 0.4306 | 1.982 | 0.6607 | 3 |
| 0.6338 | 1.373 | 0.3432 | 2.166 | 0.5415 | 4 |
| 0.6202 | 1.437 | 0.2874 | 2.317 | 0.4634 | 5 |
| 0.6093 | 1.490 | 0.2483 | 2.446 | 0.4076 | 6 |
| 0.6002 | 1.535 | 0.2193 | 2.558 | 0.3654 | 7 |
| 0.5925 | 1.575 | 0.1968 | 2.658 | 0.3322 | 8 |
| 0.5858 | 1.610 | 0.1789 | 2.748 | 0.3053 | 9 |
| 0.5799 | 1.641 | 0.1641 | 2.830 | 0.2830 | 10 |
| 0.5747 | 1.670 | 0.1518 | 2.906 | 0.2642 | 11 |
| 0.5699 | 1.696 | 0.1413 | 2.976 | 0.2480 | 12 |
| 0.5656 | 1.720 | 0.1323 | 3.041 | 0.2340 | 13 |
| 0.5617 | 1.743 | 0.1245 | 3.103 | 0.2216 | 14 |
| 0.5581 | 1.764 | 0.1176 | 3.160 | 0.2107 | 15 |
| 0.5547 | 1.783 | 0.1115 | 3.215 | 0.2009 | 16 |
| 0.5516 | 1.802 | 0.1060 | 3.267 | 0.1922 | 17 |
| 0.5487 | 1.819 | 0.1011 | 3.316 | 0.1842 | 18 |
| 0.5459 | 1.836 | 0.09662 | 3.363 | 0.1770 | 19 |
| 0.5434 | 1.852 | 0.09258 | 3.407 | 0.1704 | 20 |
| 0.5410 | 1.866 | 0.08888 | 3.450 | 0.1643 | 21 |
| 0.5387 | 1.881 | 0.08549 | 3.491 | 0.1587 | 22 |
| 0.5365 | 1.894 | 0.08237 | 3.531 | 0.1535 | 23 |
| 0.5345 | 1.908 | 0.07948 | 3.569 | 0.1487 | 24 |
| 0.5325 | 1.920 | 0.07680 | 3.606 | 0.1442 | 25 |
| | | | | | |
| 0.5799 | 1.641 | 0.1641 | 2.830 | 0.2830 | 10 |
| 0.5434 | 1.852 | 0.09258 | 3.407 | 0.1704 | 20 |
| 0.5240 | 1.976 | 0.06588 | 3.772 | 0.1257 | 30 |
| 0.5112 | 2.066 | 0.05164 | 4.041 | 0.1010 | 40 |
| 0.5017 | 2.135 | 0.04271 | 4.256 | 0.08511 | 50 |
| 0.4944 | 2.192 | 0.03654 | 4.434 | 0.07391 | 60 |
| 0.4884 | 2.241 | 0.03201 | 4.588 | 0.06554 | 70 |
| 0.4833 | 2.283 | 0.02853 | 4.722 | 0.05903 | 80 |
| 0.4790 | 2.320 | 0.02577 | 4.842 | 0.05380 | 90 |
| 0.4753 | 2.353 | 0.02353 | 4.950 | 0.04950 | 100 |

FIG.21

DETERMINING HORIZONTAL AND/OR VERTICAL PERMEABILITY OF AN EARTH FORMATION

BACKGROUND OF THE INVENTION

1. Field of the Invention

The invention concerns methods for estimating the horizontal and/or vertical components of permeability of an anisotropic earth formation.

2. The Prior Art

The permeability of an earth formation containing valuable resources such as liquid or gaseous hydrocarbons is a parameter of major significance to their economic production. These resources can be located by borehole logging to measure such parameters as the resistivity and porosity of the formation in the vicinity of a borehole traversing the formation. Such measurements enable porous zones to be identified and their water saturation (percentage of pore space occupied by water) to be estimated. A value of water saturation significantly less than one is taken as being indicative of the presence of hydrocarbons, and may also be used to estimate their quantity. However, this information alone is not necessarily adequate for a decision on whether the hydrocarbons are economically producible. The pore spaces containing the hydrocarbons may be isolated or only slightly interconnected, in which case the hydrocarbons will be unable to flow through the formation to the borehole. The ease with which fluids can flow through the formation, the permeability, should preferably exceed some threshold value to assure the economic feasibility of turning the borehole into a producing well. This threshold value may vary depending on such characteristics as the viscosity of the fluid. For example, a highly viscous oil will not flow easily in low permeability conditions and if water injection is to be used to promote production there may be a risk of premature water breakthrough at the producing well.

The permeability of a formation is not necessarily isotropic. In particular, the permeability of sedimentary rock in a generally horizontal direction (parallel to bedding planes of the rock) may be different from, and typically greater than, the value for flow in a generally vertical direction. This frequently arises from alternating horizontal layers consisting of large and small size formation particles such as different sized sand grains or clay. Where the permeability is strongly anisotropic, determining the existence and degree of the anisotropy is important to economic production of hydrocarbons.

Techniques for estimating formation permeability are known. One technique involves measurements made with a repeat formation testing tool of the type described in U.S. Pat. Nos. 3,780,575 to Urbanosky and 3,952,588 to Whitten, such as the Schlumberger RFT TM tool. A tool of this type provides the capability for repeatedly taking two successive "pretest" samples at different flowrates from a formation via a single probe inserted into a borehole wall and having an aperture of circular cross-section. The fluid pressure is monitored and recorded throughout the sample extraction period and for a period of time thereafter. Analysis of the pressure variations with time during the sample extractions ("draw-down") and the subsequent return to initial conditions ("build-up") enables a value for an effective formation permeability to be derived for each of the draw-down and build-up phases of operation.

FIG. 1 illustrates schematically the principal elements of a tool employed in taking "preset" samples. The tip 110 of a probe is inserted through mud cake 112 into the borehole wall. Mud cake 112 and a packer 114 hydraulically seal the probe tip 110 with respect to the formation 116. The probe includes a filter 118 disposed in the probe aperture and a filter-cleaning piston 120. The pretest system comprises chambers 122 and 124 and associated pistons 126 and 128. Pistons 126 and 128 are retracted in sequence each time the probe is set. Piston 126 is withdrawn first, drawing in formation fluid at a flow rate of, for example, 50 cc/min. Then piston 128 is withdrawn, causing a flow rate of, for example, 125 cc/min. FIG. 1 shows the system in mid-sequence, with piston 126 withdrawn. A strain gauge sensor 132 measures pressure in line 134 continuously during the sequence. When the probe is retracted, the pistons 126 and 128 are moved to expel the fluid, and filter cleaning piston 120 pushes debris from the probe.

The pressure measurement is recorded continuously in analog and/or digital form. FIG. 2 shows a typical analog pressure recording during pretest. A pressure draw-down $\Delta p_1$ is recorded as piston 126 is withdrawn during a time period $T_1$, and a pressure draw-down $\Delta p_2$ is recorded as piston 128 is withdrawn during a time period $T_2$. When pretest chambers 122 and 124 are full (at time $t_2$), the pressure begins to build up over a time period $\Delta t$ toward a final pressure, that of the formation.

The permeability has been estimated by analyzing the pressure recording during either buildup or drawdown. As illustrated in FIG. 3, the point 310 at which the probe tip 110 is applied to the wall of the borehole 312 coincides with the center of the latter stage of the pressure disturbance during buildup. From the perspective of a coordinate system whose axes have been suitably stretched by an amount dictated by the horizontal and vertical components of the permeability, the pressure disturbance appears to be propagating spherically outward from the probe tip 110. Thus the analysis yields a single "spherical" permeability value, consisting of a specific combination of both the horizontal and vertical components of the permeability. During drawdown, the pressure disturbance has only been analysed for the case of a homogeneous formation with isotropic permeability. For the anisotropic case, the ad hoc assumption has been made that the isotropic permeability be replaced by the "spherical" permeability. Only in some cases could the analysis yield separate values for horizontal and vertical permeabilities, and then only with the incorporation of data from other logging tools or from laboratory analysis of formation core samples. Until recently, it had been assumed impossible to derive separate horizontal and vertical permeability values solely from the measurements provided by the single-probe type of tool.

Another method of estimating formation permeability is described in U.S. Pat. No. 4,742,459 to Lasseter. FIG. 4 shows in schematic form a borehole logging device 400 useful in practicing the method. In this approach, formation pressure responses vs. time are measured at two observation probes (402 and 404) of circular cross-section as a transient pressure disturbance is established in the formation 406 surrounding the borehole 408 by means of a "source" probe 410. The observation probes are spaced apart in the borehole, probe 404 (the "horizontal" probe) being displaced from source probe 410 in the lateral direction and probe 402 (the "vertical" probe) being displaced from source probe 410 in the longitudinal direction. Hydraulic properties of the surrounding formation, such as values of permeability and hydraulic anisotropy, are derived from the measured pressure responses.

While the technique of this patent has advantages, the use of multiple spaced-apart probes has some inherent drawbacks. For example, the MRTT TM and MDT TM tools commercialized by Schlumberger and employing principles of the Lasseter patent have the observation probes spaced some 70 cm apart along the borehole. The estimate of vertical permeability is thus based on flow over a relatively large vertical distance. While this is sometimes appropriate, it is often preferable to obtain a more localized value of vertical permeability. If the longitudinally-spaced observation probes are set so that they straddle a hydraulic barrier in the formation (e.g., a formation layer of low permeability relative to the layers in which the probes are set), the values determined for vertical permeability and hydraulic anisotropy may differ significantly from the local characteristics of the formation layers above and below the barrier. Moreover, the technique of the Lasseter patent may require simultaneous hydraulic seating of three probes, though it may be possible to make both horizontal and vertical measurements with only two probes. Accurate measurement may be prevented if one or more of the probes fails to seal properly, such as where the borehole surface is uneven. While even a single-probe system can encounter seating problems, the need for simultaneous seating of multiple probes may increase the difficulty of obtaining the desired measurement.

A method for determining the various components of the permeability of an anisotropic formation with a single probe is described in U.S. Pat. No. 4,890,487 to Dussan V. et al. See also E. B. DUSSAN V. et al., *An Analysis of the Pressure Response of A Single-Probe Formation Tester*, SPE Paper No. 16801, presented at the 62nd Annual Technical Conference and Exhibition of the Society of Petroleum Engineers (1987). Pressure draw-down and build-up are measured as fluid samples are extracted from the formation at controlled flow rates with a logging tool having a single extraction probe of circular cross-section. This may be done with a system as shown in FIG. 1, producing a pressure recording as shown in FIG. 2. The measured build-up and draw-down data are analyzed to derive separate values for horizontal and vertical formation permeability. This is possible because they successfully analyze the pressure disturbance during draw-down for an anisotropic formation. This technique offers a localized determination of hydraulic anisotropy, and avoids the need to incorporate data from other logging tools or core analysis. It has the disadvantage that it relies on measurement of pressure build-up, which demands an extremely fast-responding pressure transducer with a very high sensitivity. Pressure draw-down is a relatively robust measurement—pressure is measured before and after the pressure disturbance caused by fluid extraction. Pressure build-up is a more delicate measurement because the rate of pressure recovery must be measured accurately as the detected pressure asymptotically approaches formation pressure (the pressure recovers at a rate of $1/t^{3/2}$).

A further technique for determining permeability is performed in the laboratory using formation samples and a laboratory instrument known as a mini-permeameter. The instrument has an injection probe with a nozzle of circular cross-section which is pressed against the surface of a sample and appropriately sealed. Pressurized gas flows through the injection nozzle into the rock sample as gas flow and injection pressure are measured. Referring to the schematic view of FIG. 5, the process may be performed on a first face 510 having its longitudinal (z) axis perpendicular to the bedding planes of a formation sample 500 and on a second face 520 having its longitudinal (x or y) axis parallel to the bedding planes of the formation sample. The measured flows through the sample are used in determining permeability. See, for example, R. EIJPE et al., *Geological Note: Mini-Permeameters for Consolidate Rock and Unconsolidated Sand*, THE AMERICAN ASSOCIATION OF PETROLEUM GEOLOGISTS BULLETIN, Vol. 55, No. 2, pp. 307–309 (1971); C. MCPHEE, PROPOSED MINI-PERMEAMETER EVALUATION REPORT, Edinburgh Petroleum Equipment, Ltd., Edinburgh, Scotland (1987); and D. GOGGIN et al., *A Theoretical and Experimental Analysis of Minipermeameter Response Including Gas Slippage and High Velocity Flow Effects*, IN SITU, 12(1&2), pp. 79–116 (1988).

Determining horizontal and/or vertical permeabilities of a formation with a mini-permeameter has a number of important limitations. The mini-permeameter is a laboratory instrument, and cannot be used to make in situ measurements in a well bore. Thus, it can only be used to make the necessary measurements if formation core samples are available, which is not always the case. Moreover, it entails destruction of portions of the core sample, as a smaller sample having a smooth face parallel to and perpendicular to the bedding planes must be cut from the sample for testing. Also, the mini-permeameter measures the permeability of isotropic samples. In the case of an anisotropic sample, it only gives an effective value. Thus, it would only give an effective vertical and effective horizontal permeability from the two faces 510 and 520, respectively.

SUMMARY OF THE INVENTION

It is an object of this invention to provide improved methods for determining horizontal and vertical permeabilities of an earth formation. It is further an object of the present invention to provide methods which may be performed in situ or at the earth's surface. Another object of the invention is to provide methods which avoid limitations of the prior art methods described above. These and other objects are attained in accordance with exemplary embodiments of the invention described below.

In a preferred embodiment, fluid flow measurements are made in situ using a repeat formation tester with a modified probe aperture, or a mini-permeameter with a modified probe aperture. The modified probe aperture has an elongate cross-section, such as elliptic or rectangular. A first flow measurement is made with the longer dimension of the probe aperture in a first orientation (e.g., horizontal or vertical) with respect to the formation bedding planes. A second flow measurement is made with the probe aperture orthogonal to the first orientation, or with a probe aperture of non-elongate (e.g., circular) cross-section. Simultaneous equations relating values of known and measured quantities are solved to obtain estimates of local horizontal and/or vertical formation permeability.

BRIEF DESCRIPTION OF THE DRAWING

Preferred embodiments of the invention are described in more detail below with reference to the accompanying drawing, in which:

FIG. 10 is a table of values constructed in accordance with the invention for an elliptic probe aperture having an aspect ratio of 0.2 oriented vertically and horizontally;

FIG. 13 is a table of values constructed in accordance with the invention for an elliptic probe aperture having an aspect ratio of 0.01 oriented vertically and horizontally;

FIG. 18 is a table of values constructed in accordance with the invention for a rectangular probe aperture having an aspect ratio of 0.2 oriented vertically and horizontally;

FIG. 21 is a table of values constructed in accordance with the invention for a circular probe aperture and an elliptic probe aperture having an aspect ratio of 0.2 oriented horizontally;

DETAILED DESCRIPTION OF THE PREFERRED EMBODIMENTS

The invention concerns nondestructive techniques for estimating the horizontal and/or vertical components of permeability of an anisotropic earth formation. As formations of interest typically comprise sedimentary rock, it is assumed that the formation is isotropic in the horizontal directions, and has a smaller permeability in the vertical direction than in the horizontal. For purposes of this description, the "horizontal" directions are those generally parallel to the bedding planes of the rock, and the "vertical" direction is generally perpendicular to the bedding planes of the rock. The term "formation" comprises a formation sample, such as a core plug taken from a borehole. In the case of a formation sample, "formation fluid" may be a liquid or a gas such as atmospheric air. It is noted that where a gas zone under consideration has been contaminated with liquid, measurements should be treated as if the formation sample is a liquid.

In accordance with the invention, flow measurements are made to obtain values from which the permeability components of an earth formation are estimated. The flow measurements may be conducted in situ and/or in the laboratory using formation samples. In situ measurements are preferably made in a borehole with a formation test tool having a probe aperture modified as described below. Formation test tools which may be employed include the Schlumberger RFT TM tester, MRTT TM tester and MDT TM tester. Laboratory measurements and measurements on outcrops are preferably made with a mini-permeameter having a probe aperture modified as described below.

The technique can be performed using a single probe. Pressure measurements are taken at the probe, through which fluid is forced to flow under substantially steady-state, single-phase conditions. For downhole measurements, the flow is preferably induced by drawing formation fluid into the tool through the probe ("drawdown"). Alternately, fluid may be injected into the formation through the probe ("injection"). Gas injection is preferred for laboratory measurements with formation samples. Whether fluid is drawn into the probe or injected out through the probe, a pressure disturbance is caused in the formation fluid.

The technique may be used to determined permeability on a length scale similar to that of the Hassler core. Thus, permeability determined by this technique should be comparable to that obtained using the recognized standard procedure in the petroleum industry.

Figure 6:
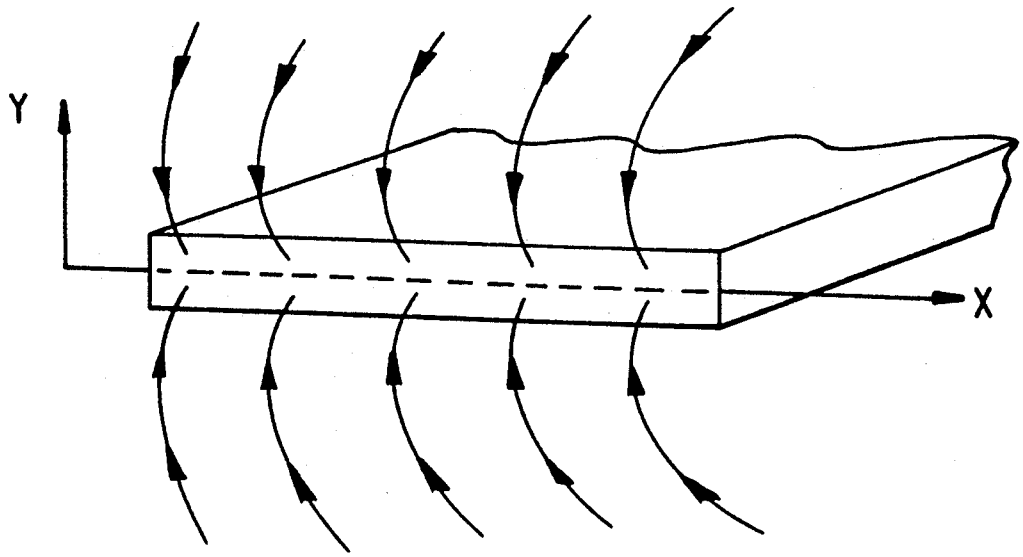
FIG. 6 illustrates generally vertical fluid flow into a horizontally-oriented, elongate probe aperture in accordance with the invention.
Figure 7:
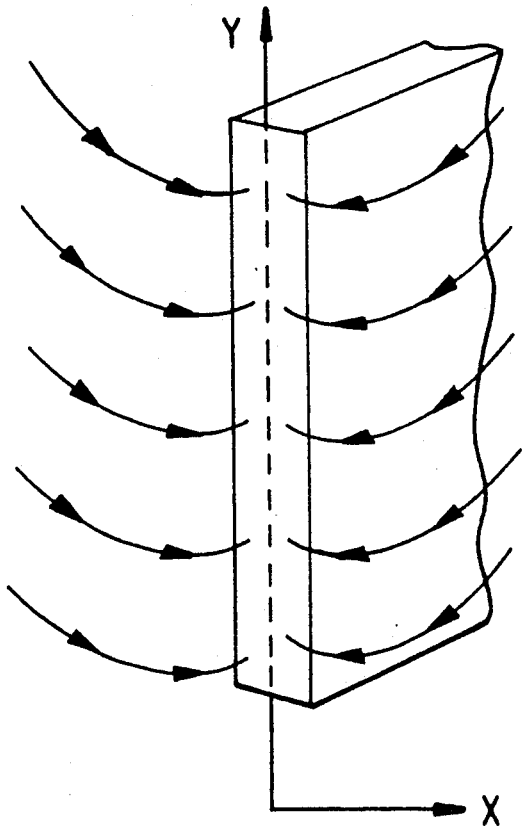
FIG. 7 illustrates generally horizontal fluid flow into a vertically-oriented, elongate probe aperture in accordance with the invention.

Preferred methods of estimating horizontal and/or vertical permeability in accordance with the invention differ in at least two significant ways from the prior art methods described above. First, a probe having an aperture of non-circular cross-section is employed. The probe is that part of the tool or instrument in contact with the formation or formation specimen. Fluid is displaced through the probe aperture in making a measurement. The aperture is preferably shaped as a narrow slit, a small aspect ratio (width/length) being of more importance than the exact shape of the cross-section. The slit shape allows fluid to be drawn or injected in a pattern which corresponds to the direction of measurement. For example, FIG. 6 shows the probe oriented horizontally. As can be seen from the flow lines in FIG. 6, the fluid enters the probe (in the case of draw-down) along the vertical axis Y. Similarly, FIG. 7 shows the probe oriented vertically. The flow lines in FIG. 7 show the fluid entering the probe (in the case of a draw-down) along a horizontal axis X. The limit on the smallness of the aspect ratio results from a desire to avoid clogging, and the size of the diameter (maximum length) of the probe. The aspect ratio as defined (width/length) is less than 1.0.

Second, measurements are taken during two pressure disturbances (e.g., during two draw-downs), with the aperture oriented in two different directions with respect to the formation or formation specimen during the two measurements. For example, the aperture is oriented in a first direction (e.g., horizontal) during a first draw-down, and is oriented in a second direction (e.g., vertical) orthogonal to the first direction during a second draw-down. The "orientation" is the direction of the longest dimension of the aperture cross-section.

A number of variations are possible. For example, the non-circular aperture cross-section may be generally elliptic or rectangular or of some other elongate or slit-like form. Instead of pressure draw-downs caused by withdrawal of fluid from the formation, pressure increases caused by injection of fluid into the formation may be used. A combination of a pressure draw-down and a pressure increase (injection) may be used in place of two draw-downs. Probes with two different aperture cross-sections may be used for the two pressure disturbance (drawdown and/or injection) measurements—for example, one of the aperture cross-sections can be circular, provided the other aperture cross-section has a small aspect ratio (ratio of width to length).

Determination of horizontal and/or vertical permeability in accordance with the preferred embodiments is based upon our derived relationship among the following parameters: the volumetric flowrate, Q, and the viscosity, $\mu$, of the fluid forced to pass through the aperture of the probe during draw-down or injection, the horizontal, $k_h$, and vertical, $k_v$, components of the permeability of the formation, the pressure at the probe, $P_p$, the pressure of the formation far from the probe (equivalent to the pressure measured by the probe when the formation fluid is in its undisturbed state), $P_f$, and the probe aperture dimensions $2\times l_h$ and $2\times l_v$. This relationship is obtained from the solution to the following boundary value problem wherein liquid is the fluid under consideration:

$$k_v\frac{\partial^2 P}{\partial z^2} + k_h\left(\frac{\partial^2 P}{\partial x^2} + \frac{\partial^2 P}{\partial y^2}\right) = 0, \tag{1}$$

$$P = P_p \text{ at } \frac{x^2}{l_h^2} + \frac{z^2}{l_v^2} \leqq 1 \text{ and } y = 0, \tag{2}$$

$$\frac{\partial P}{\partial y} = 0 \text{ at } \frac{x^2}{l_h^2} + \frac{z^2}{l_v^2} > 1 \text{ and } y = 0, \tag{3}$$

-continued $$P \rightarrow P_f \text{ as } x^2 + y^2 + z^2 \rightarrow \infty \text{ and } y \geqq 0.$$

Due to the difference in compressibility between liquid and gas, the equations for gas become:

$$k_v\frac{\partial^2 (P^2)}{\partial z^2} + k_h\left(\frac{\partial^2 (P^2)}{\partial x^2} + \frac{\partial^2 (P^2)}{\partial y^2}\right) = 0, \tag{5}$$

$$(P^2) = (P_p^2) \text{ at } \frac{x^2}{l_h^2} + \frac{z^2}{l_v^2} \leqq 1 \text{ and } y = 0, \tag{6}$$

$$\frac{\partial (P^2)}{\partial y} = 0 \text{ at } \frac{x^2}{l_h^2} + \frac{z^2}{l_v^2} > 1 \text{ and } y = 0, \tag{7}$$

$$(P^2) \rightarrow (P_f^2) \text{ as } x^2 + y^2 + z^2 \rightarrow \infty \text{ and } y \geqq 0. \tag{8}$$

Figure 8:
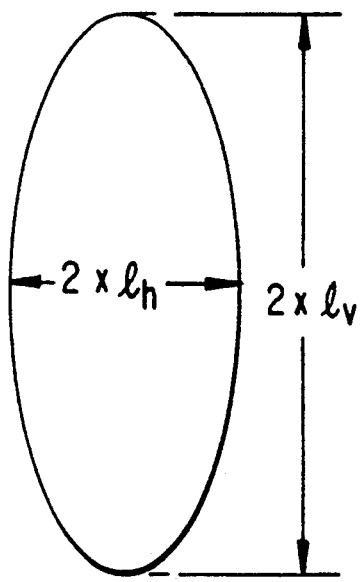
FIG. 8 shows a probe aperture in accordance with the invention having a cross-section of an elliptical shape of "width" $2\times l_h$ and "length" $2\times l_v$.

P denotes the pressure field within the formation, and (x, y, z) denotes a rectangular Cartesian coordinate system oriented such that the x-axis and y-axis point in the horizontal directions and the z-axis points in the vertical direction, with the $y=0$ surface closely approximating the location of the borehole wall near the probe and the formation occupying the domain $y\geqq 0$. In the case of the mini-permeameter, it is assumed that measurements are being made on a face of the formation sample which would satisfy these conditions if it was still in the ground. For the moment, the cross-section of the probe aperture is assumed to have an elliptical shape of "width" $2\times l_h$ and "length" $2\times l_v$, such as shown in FIG. 8. (Examples of other possible aperture cross-sections are discussed below.) In Equation (1), the "$k_v$" term, $k_v(\partial^2 P/\partial z^2)$, relates to formation permeability in the vertical direction and the "$k_h$" term, $k_h(\partial^2 P/\partial x^2 + \partial^2 P/\partial y^2)$, relates to formation permeability in an isotropic horizontal plane. Similarly, in Equation (5) the "$k_v$" term relates to formation permeability in the vertical direction and the "$k_h$" term relates to formation permeability in an isotropic horizontal plane.

The desired relationship follows from the definition of volumetric flow rate, Q, $$Q = \frac{k_h}{\mu}\int_{A_P} \frac{\partial P}{\partial y}\Big|_{y=0} dx dz, \tag{9}$$

where $A_p$ denotes the area of the aperture of the probe. The solution to this boundary-value problem appears in J. N. GOODIER et al., ELASTICITY AND PLASTICITY, John Wiley & Sons, Inc., pp. 29–35 (1958). It gives $$K_H = \tag{10}$$

$$\begin{cases} \dfrac{2r_p}{\pi l_v} F\left(\dfrac{\pi}{2}, \left(1 - \dfrac{K_V l_h^2}{K_H l_v^2}\right)^{\frac{1}{2}}\right) \text{for } \dfrac{K_V l_h^2}{K_H l_v^2} \leqq 1 \\ \dfrac{2r_p K_H^{\frac{1}{2}}}{\pi l_h K_V^{\frac{1}{2}}} F\left(\dfrac{\pi}{2}, \left(1 - \dfrac{K_H l_v^2}{K_V l_h^2}\right)^{\frac{1}{2}}\right) \text{for } \dfrac{K_V l_h^2}{K_H l_v^2} > 1, \end{cases}$$

where F denotes the complete elliptic integral of the first kind, and $r_p$ denotes the effective probe radius, defined as $$r_p = \sqrt{l_h^2/2 + l_v^2/2}\ . \tag{11}$$

$K_H$ and $K_V$ denote the dimensionless horizontal component and the dimensionless vertical component of the permeability, respectively. For liquid:

$$K_H = \frac{4r_p(P_p - P_f)k_h}{Q\mu} \text{ and } K_V = \frac{4r_p(P_p - P_f)k_v}{Q\mu}\ . \tag{12}$$

For gas:

$$K_H = \frac{4r_p[(P_p^2 - P_f^2)/2P_p]k_h}{Q\mu} \text{ and } K_V = \frac{4r_p[(P_p^2 - P_f^2)/2P_p]k_v}{Q\mu}\ . \tag{13}$$

Figure 1:
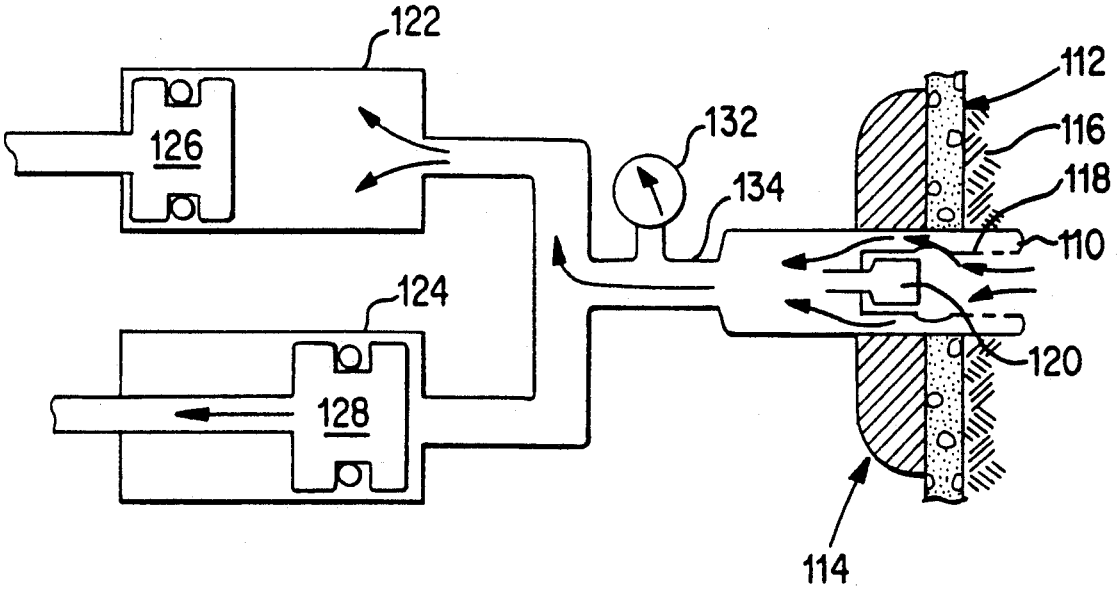
FIG. 1 PRIOR ART
FIG. 1 illustrates schematically the principal elements of a prior-art tool employed in taking "pretest" formation fluid samples in a borehole.
Figure 2:
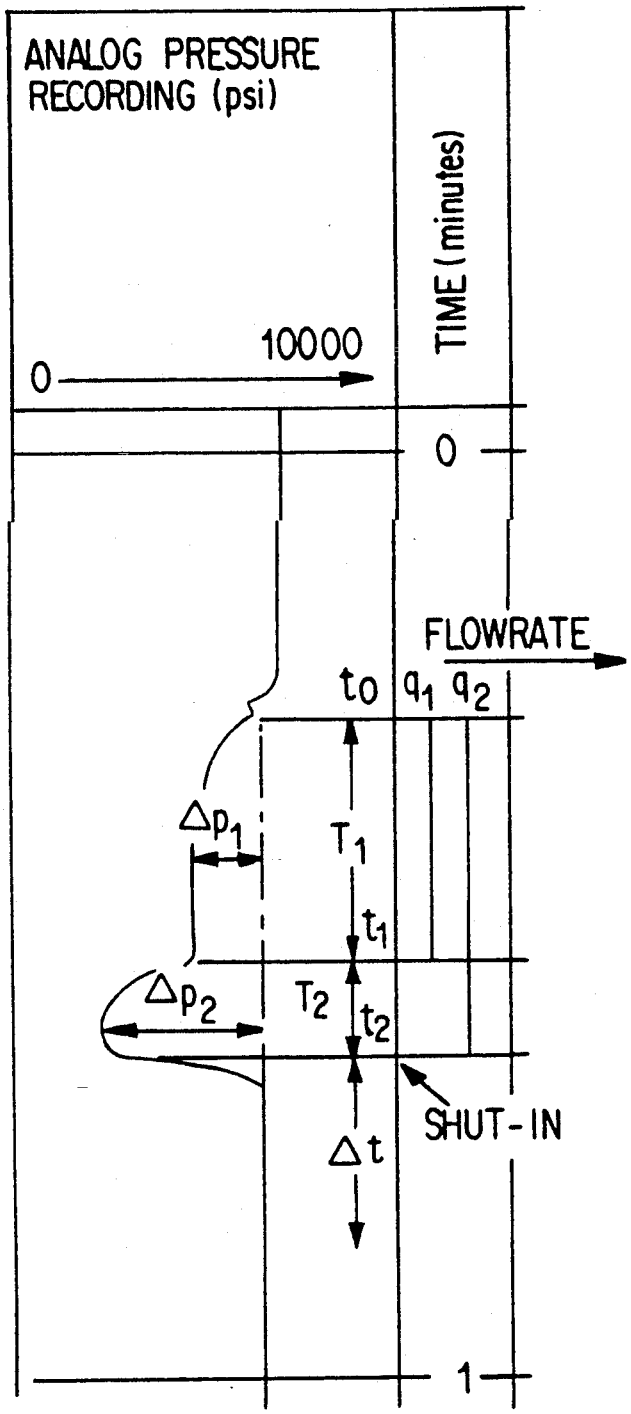
FIG. 2 PRIOR ART
FIG. 2 shows a typical analog pressure recording made during pretest sampling with a tool of the type shown in FIG. 1.
Figure 3:
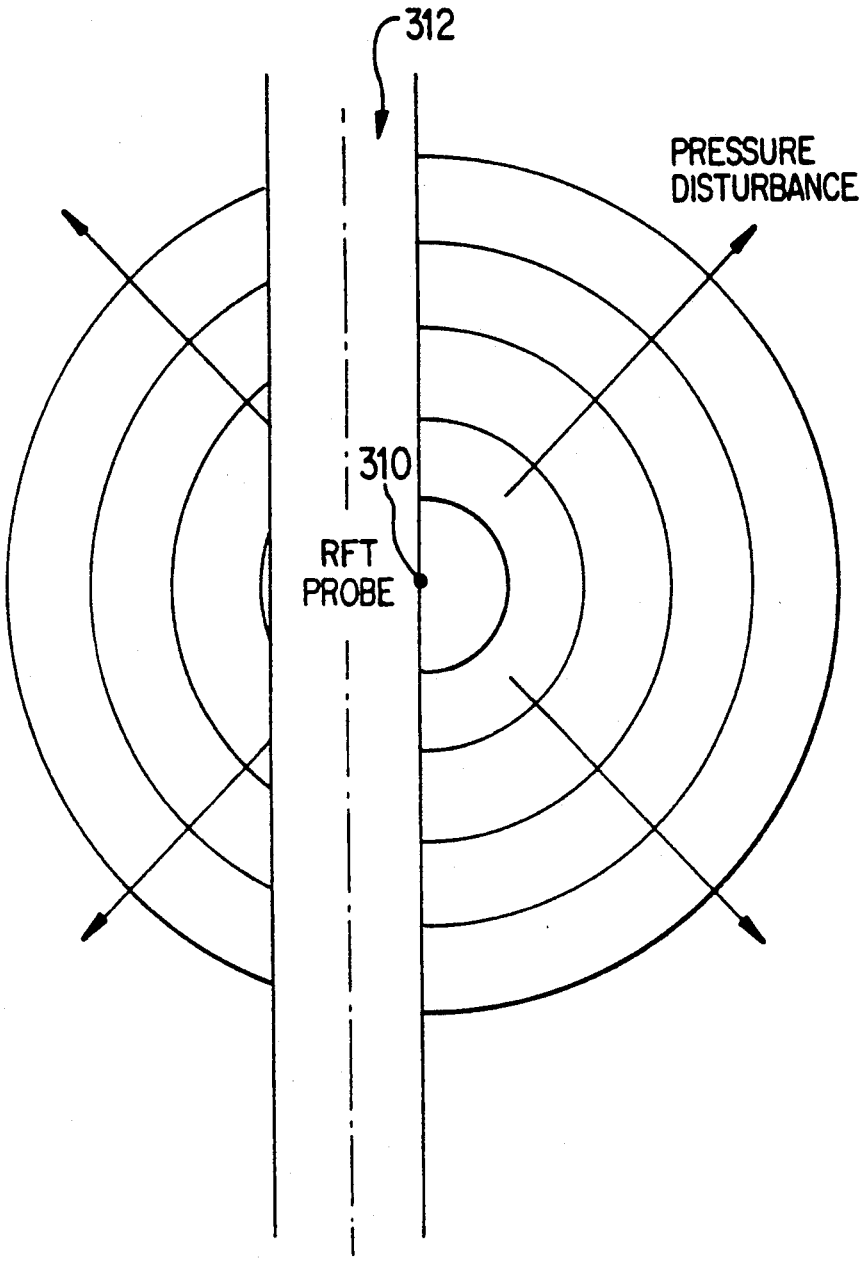
FIG. 3 PRIOR ART
FIG. 3 illustrates a prior-art model of a pressure disturbance in a formation.
Figure 4:
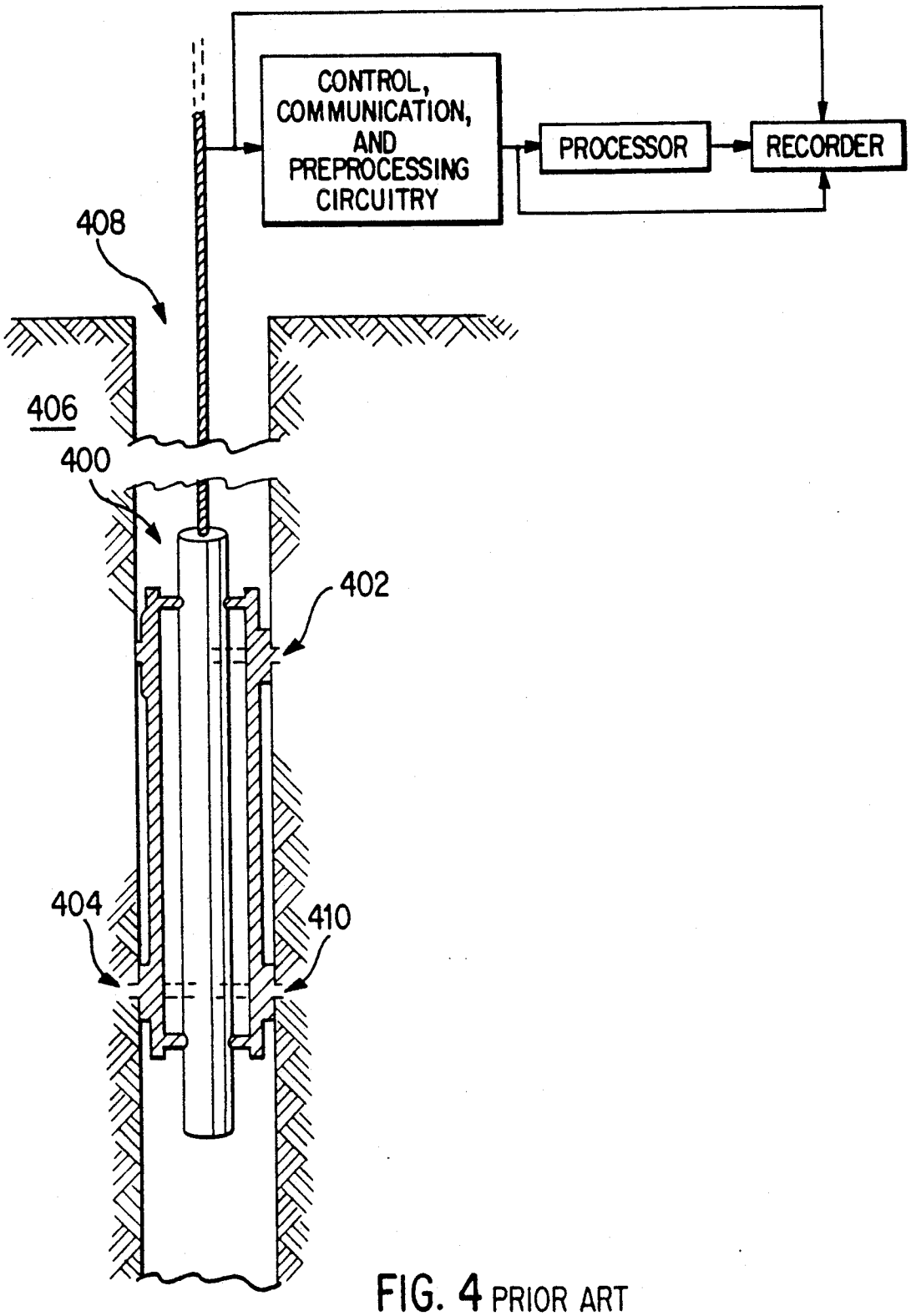
FIG. 4 PRIOR ART
FIG. 4 illustrates schematically a prior-art borehole logging device having a source probe and a spaced-apart pair of observation probes for formation testing.
Figure 5:
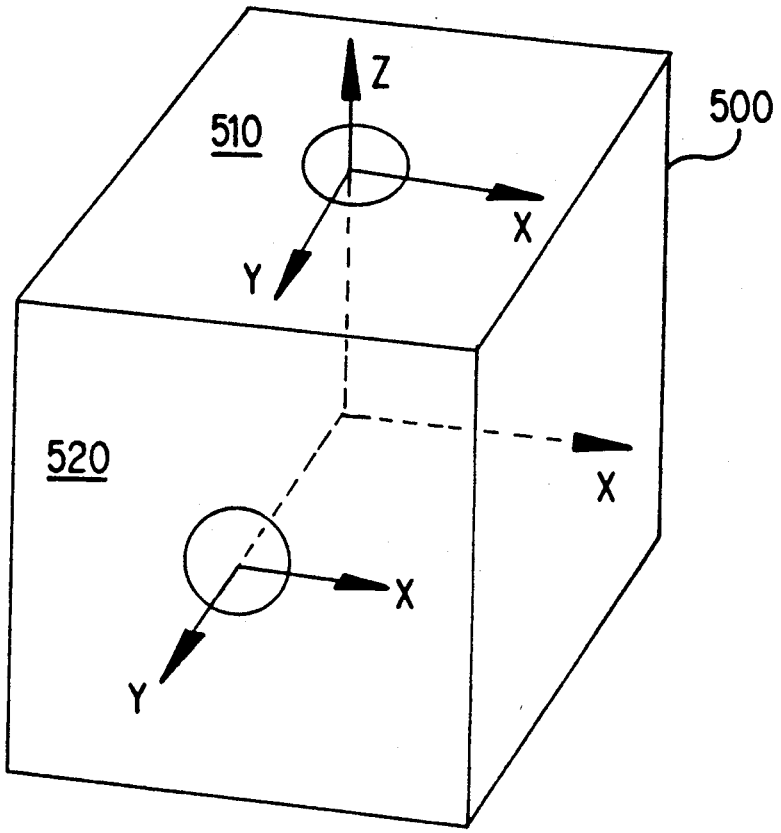
FIG. 5 PRIOR ART
FIG. 5 illustrates a formation sample used for mini-permeameter testing in accordance with the prior art.
Figure 9:
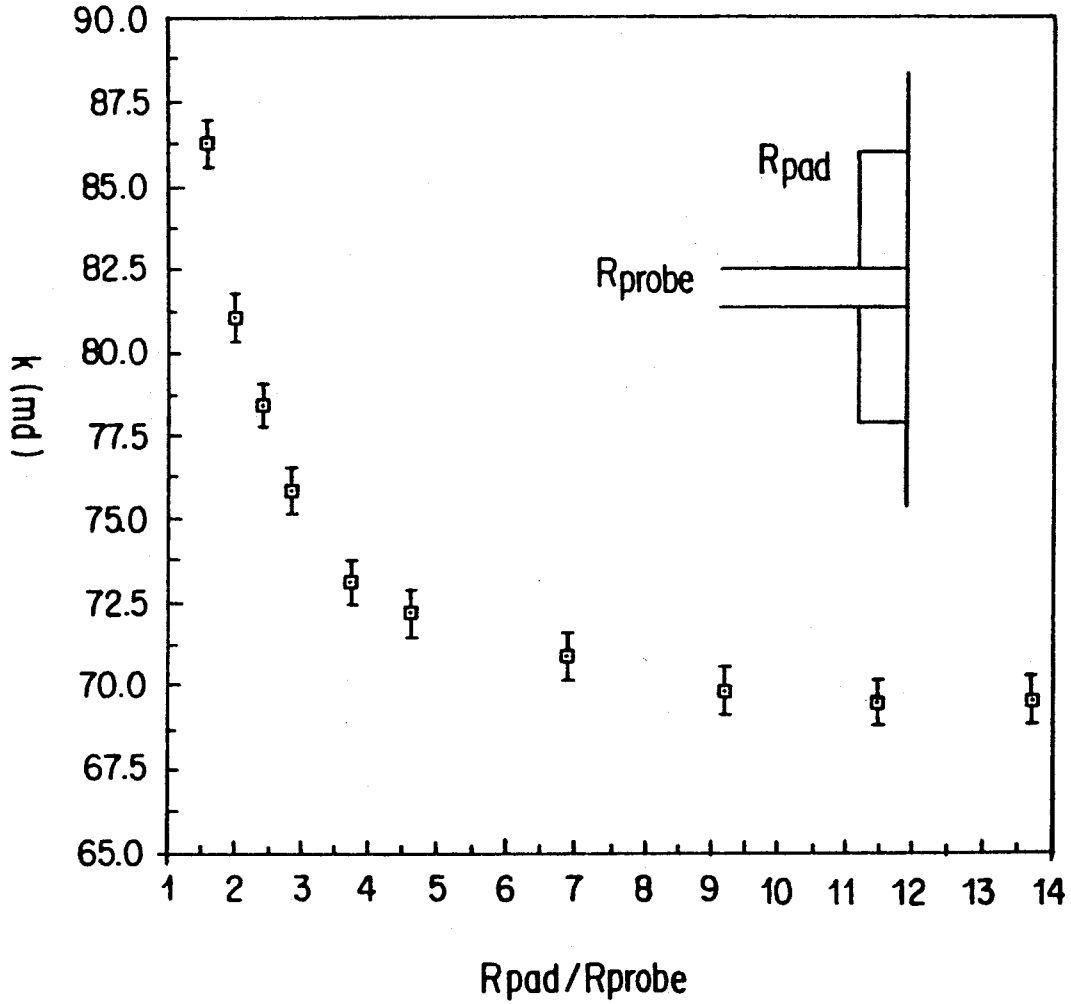
FIG. 9 is a plot in accordance with the invention of values of formation permeability versus preferred ratios of the radius of the impermeable pad to the radius of the probe aperture for laboratory testing with a mini-permeameter.

It is assumed for in situ measurements that the aperture cross-section is sufficiently small compared to the radius of the hole (e.g., the well bore) containing the formation tester that the surface of the formation near the probe can be regarded as planar. For laboratory measurements (e.g., using a minipermeameter and a formation sample), it is assumed that an impermeable pad surrounds the probe aperture to provide a hydraulic seal between the probe tip and the sample. The size of the pad and the formation sample are assumed to be large enough to justify the no-flux boundary condition on the entire y=0 surface (other than at the aperture) and the use of the semi-infinity domain (e.g., the "half-space" of D. GOGGIN et al., *A Theoretical and Experimental Analysis of Minipermeameter Response Including Gas Slippage and High Velocity Flow Effects*, IN SITU, 12(1&2), pp. 79-116 (1988), at FIG. 1). FIG. 9 plots values of permeability, k, versus preferred ratios of $R_{pad}/R_{probe}$, where $R_{pad}$ is the radius of the impermeable pad and $R_{probe}$ is the radius of the probe aperture. Pad dimensions for in situ measurement are less critical, in part due to the sealing effect of mud-cake at the borehole wall.

The dimensionless horizonal and vertical components of the permeability are determined as follows. Let $2\times l_s$ and $2\times l_l$ denote the smallest and largest dimensions of the aperture of the probe, respectively. It will be recalled that we are interested in any aperture having a small aspect ratio, i.e., the ratio $l_s/l_l$ is a small number. A vertical orientation of the probe aperture assumes $l_h$ equals $l_s$, and $l_v$ equals $l_l$. A horizontal orientation of the probe assumes $l_h$ equals $l_l$, and $l_v$ equals $l_s$. It is further assumed that two drawdowns are performed. During the first drawdown fluid flows through the probe at a volumetric flowrate corresponding to $Q_1$, with the probe oriented vertically. During the second drawdown fluid flows through the probe at a volumetric flowrate corresponding to $Q_2$, with the probe oriented horizontally. It is assumed that the values of $Q_1$ and $Q_2$ are known; they need not be equal. This gives rise to the following two simultaneous equations containing only two unknowns, $K_{H1}$ and $K_{V1}$:

$$K_{H1} = \tag{14}$$

-continued $$\begin{cases} \dfrac{2r_p}{\pi l_v} F\left(\dfrac{\pi}{2}, \left(1 - \dfrac{K_{V1}l_s^2}{K_{H1}l_l^2}\right)^{\frac{1}{2}}\right) \text{for } \dfrac{K_{V1}l_s^2}{K_{H1}l_l^2} \leqq 1 \\ \dfrac{2r_pK_{H1}^{\frac{1}{2}}}{\pi l_sK_{V1}^{\frac{1}{2}}} F\left(\dfrac{\pi}{2}, \left(1 - \dfrac{K_{H1}l_l^2}{K_{V1}l_s^2}\right)^{\frac{1}{2}}\right) \text{for } \dfrac{K_{V1}l_s^2}{K_{H1}l_l^2} > 1, \end{cases}$$

and $$\frac{K_{H1}}{M} = \tag{15}$$

$$\begin{cases} \dfrac{2r_p}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_pK_{H1}^{\frac{1}{2}}}{\pi l_lK_{V1}^{\frac{1}{2}}} F\left(\dfrac{\pi}{2}, \left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1. \end{cases}$$

The subscripts 1 and 2 refer to the pressure at the probe and flow rate through the probe corresponding to the first draw-down and the second draw-down, respectively, in the definitions of $K_H$ and $K_V$. The definition of the quantity M for liquid is given by:

$$M = \frac{Q_2(P_{p1} - P_f)}{Q_1(P_{p2} - P_f)}\ . \tag{16}$$

The definition of the quantity M for gas is given by:

$$M = \frac{Q_2(P_{p1}^2 - P_f^2)P_{p2}}{Q_1(P_{p2}^2 - P_f^2)P_{p1}}\ . \tag{17}$$

The value of quantity M is readily obtained from the measured pressures and known flow rates, and is equivalent to both $K_{H1}/K_{H2}$ and to $K_{V1}/K_{V2}$. The values of $K_{H1}$ and $K_{V1}$, hence the values of $k_h$ and $k_v$, are determined from the solution to the above set of equations.

Values for $K_{H1}$ and $K_{V1}$ can be obtained by using a table such as Table 1 shown in FIG. 10. The table is constructed from the above set of equations by evaluating the quantities M, $K_{H1}$, $K_{V1}$, $K_{H2}$, and $K_{V2}$ over a range of values of the anisotropy, $k_h/k_v$, of the formation, for a given aperture aspect ratio $l_s/l_l$. Table 1 is constructed for an elliptical aperture having aspect ratio $l_s/l_l=0.2$ oriented vertically (subscript 1) and horizontally (subscript 2). The evaluation makes use of the facts that $k_h/k_v=K_{H1}/K_{V1}$, $K_{H2}=K_{H1}/M$, and the value of $l_s/l_l$ is known. That is, for a selected value of $k_h/k_v$, equation (14) is used to evaluate $K_{H1}$ and equation (15) is used to evaluate $K_{H1}/M$. The value of M is obtained by evaluating the ratio $K_{H1}/K_{H2}$. Finally, $K_{V1}$ and $K_{V2}$ are obtained by evaluating $(k_v/k_h)\times K_{H1}$ and $(k_v/k_h)\times K_{H2}$, respectively. These evaluations determine a row in the table. Additional rows of the table are obtained by repeating these evaluations for the desired range of values for $k_h/k_v$.

To use the table, a value of M is calculated from measured pressure values and known flow rates of a set of pretest measurements made with the probe aperture oriented in the vertical direction during a first drawdown and in the horizontal direction during a second draw-down, or vice versa (see equation (16) for liquids and equation (17) for gases). The values of $K_{H1}$ and $K_{V1}$ (or $K_{H2}$ and $K_{V2}$) in the same row as the calculated value of M represent the solution to the above set of equations. For example, if $l_s/l_l$ equals 0.2 and M equals 0.6732, then Table 1 (FIG. 10) gives a value for $K_{H1}$ of 1.905 and a value for $K_{V1}$ of 0.1905. The explicit values of $k_h$ and $k_v$ follow directly from the definitions of $K_{H1}$ and $K_{V1}$ (or $K_{H2}$ and $K_{V2}$), and the known values of $P_{p1}$, $P_{p1}-P_f$ (or $P_{p2}$, $P_{p2}-P_f$), $Q_1$ (or $Q_2$), $\mu$, and $r_p$ (i.e., $$r_p = \sqrt{l_s^2/2 + l_l^2/2}\,). \tag{18}$$

Figure 11:
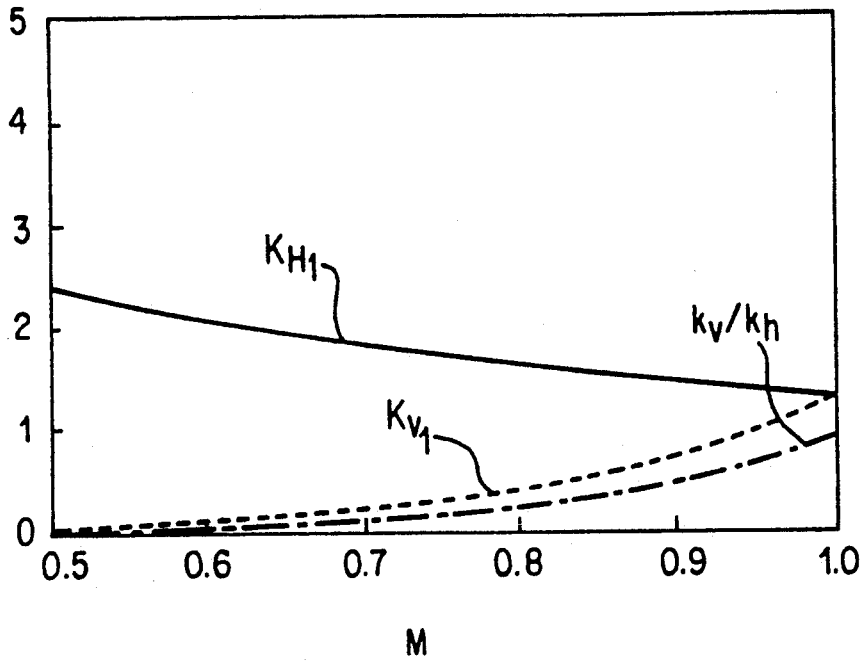
FIG. 11 is a graphic representation of the data presented in the first, second, third and sixth columns of the table of FIG. 10.
Figure 12:
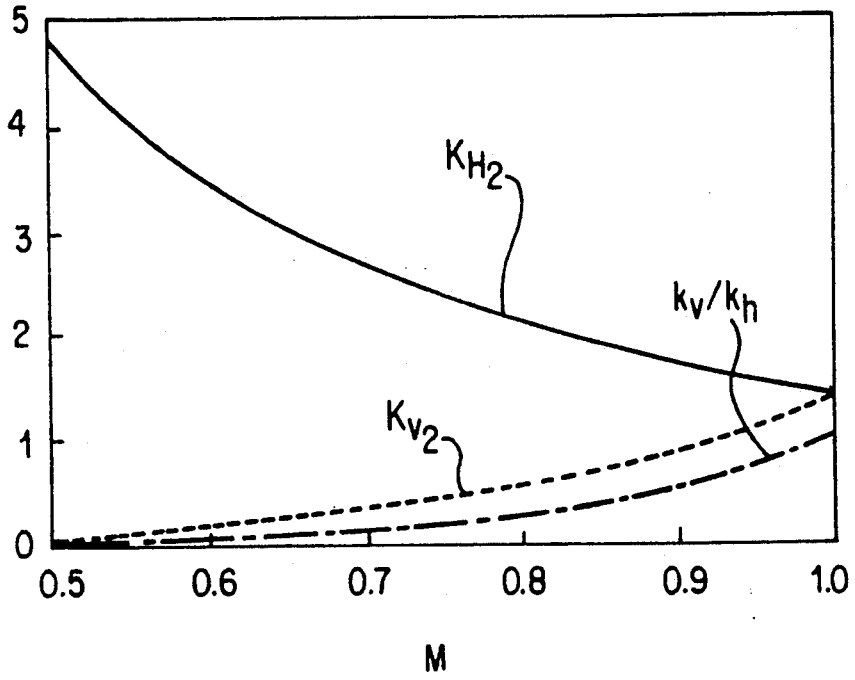
FIG. 12 is a graphic representation of the data presented in the first, fourth, fifth and sixth columns of the table of FIG. 10.

FIGS. 11 and 12 graphically represent the data presented in Table 1. In FIG. 11, the values of the anisotropy, $k_v/k_h$, and the dimensionless components of the permeability, $K_{H1}$ and $K_{V1}$ are plotted versus values of calculated measurement factor M for an elliptic probe aperture having an aspect ratio of 0.2. The plotted values correspond to data presented in the first, second, third, and sixth columns of Table 1. The subscript 1 denotes data characterizing the vertically oriented probe. In FIG. 12, the values of the anisotropy, $k_v/k_h$, and the dimensionless components of the permeability, $K_{H2}$ and $K_{V2}$, are plotted versus values of calculated measurement factor M for an elliptic probe aperture having an aspect ratio of 0.2. The plotted values correspond to data presented in the first, fourth, fifth, and sixth columns of Table 1. The subscript 2 denotes data characterizing the horizontally oriented probe. The values of the anisotropy, $k_v/k_h$, and the dimensionless components of the permeability, $K_{H1}$ and $K_{V1}$ (or $K_{H2}$ and $K_{V2}$), can be determined directly from these graphs.

Figure 14:
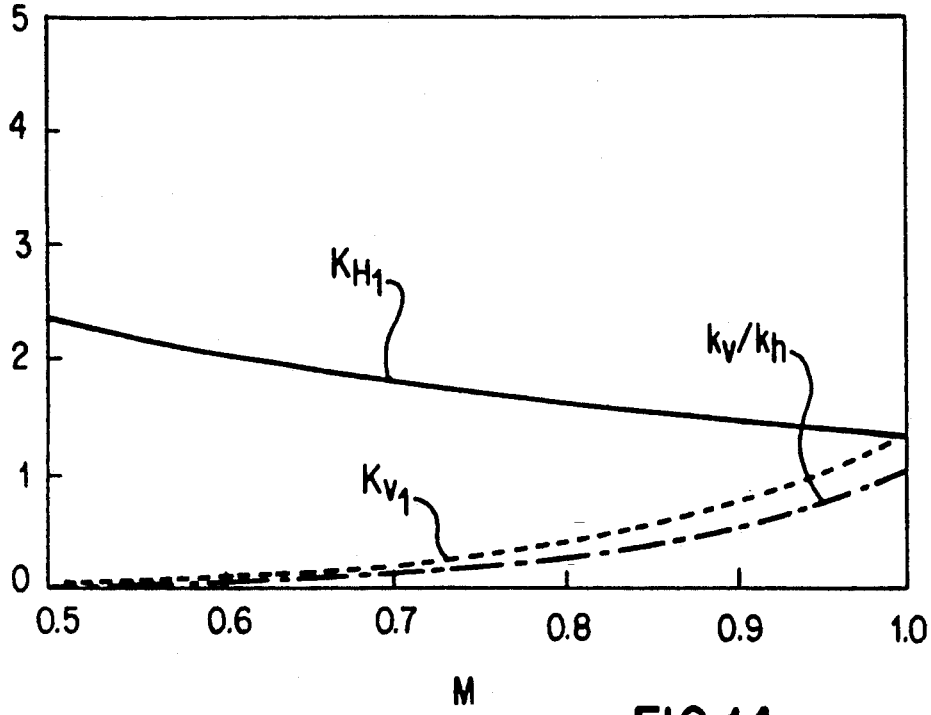
FIG. 14 is a graphic representation of the data presented in the first, second, third and sixth columns of the table of FIG. 13.
Figure 15:
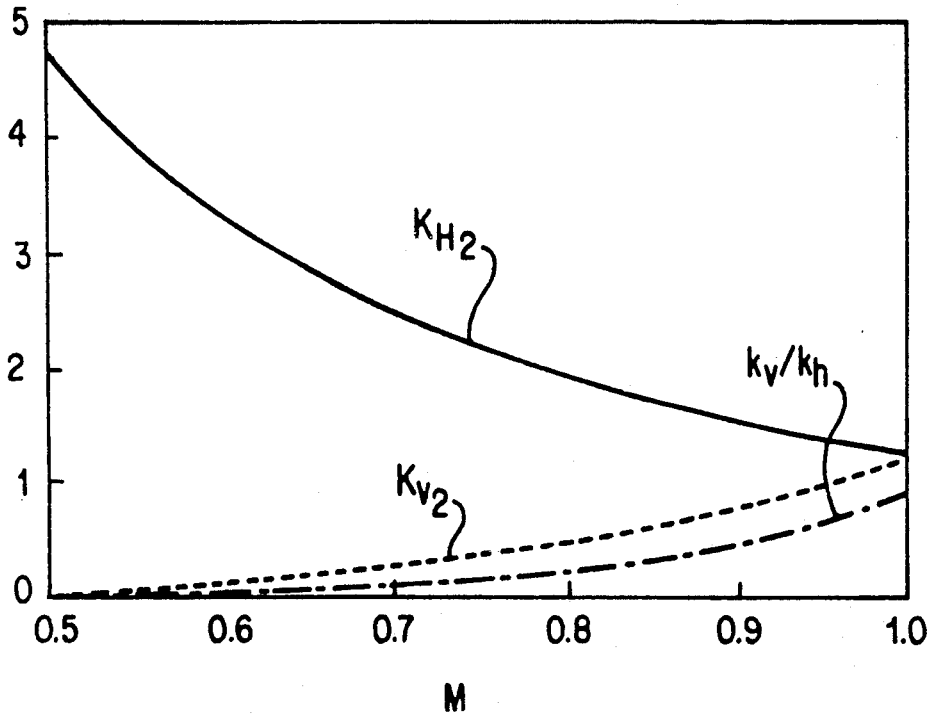
FIG. 15 is a graphic representation of the data presented in the first, fourth, fifth and sixth columns of the table of FIG. 13.

Table 2 (FIG. 13) gives values for an elliptic aperture having an aspect ratio $l_s/l_l$ of 0.01 oriented vertically and horizontally. The data of Table 2 is presented graphically in FIGS. 14 and 15. In FIG. 14, the values of the anisotropy, $k_v/k_h$, and the dimensionless components of the permeability, $K_{H1}$ and $K_{V1}$, are plotted versus values of calculated measurement factor M for an elliptic probe aperture having an aspect ratio of 0.01. The plotted values correspond to data presented in the first, second, third, and sixth columns of Table 2. The subscript 1 denotes data characterizing the vertically oriented probe. In FIG. 15, the values of the anisotropy, $k_v/k_h$, and the dimensionless components of the permeability, $K_{H2}$ and $K_{V2}$, are plotted versus values of calculated measurement factor M for an elliptic probe aperture having an aspect ratio of 0.01. The plotted values correspond to data presented in the first, fourth, fifth, and sixth columns of Table 1. The subscript 2 denotes data characterizing the horizontally oriented probe. The values of the anisotropy, $k_v/k_h$, and the dimensionless components of the permeability, $K_{H1}$ and $K_{V1}$ (or $K_{H2}$ and $K_{V2}$), can be determined directly from these graphs.

It is also rather straight-forward to determine the propagation of error from the measured quantity M to the predicted quantities $k_h$ and $k_v$. If there is a $\pm 10\%$ error in M, then the range of possible values of $K_H$ and $K_V$ corresponds to their values in rows bracketed by M equal to $1.1\times M$ and $0.9\times M$. For example, if $l_s/l_l$ equals 0.2 and M equals 0.67, then Table 1 (FIG. 10) gives for the vertical probe $1.77 \leqq K_{H1} \leqq 2.07$, or, $1.92\pm 7.6\%$ error, and $0.97 \leqq K_{V1} \leqq 0.32$, or, $0.21\pm 54\%$ error, and for the horizontal probe $2.38 \leqq K_{H2} \leqq 3.42$, or $2.90\pm 17.8\%$ error, and $0.17 \leqq K_{V2} \leqq 0.44$, or, $0.31\pm 43\%$ error. In this case, the most accurate determination of $K_H$ and $K_V$ is obtained using the results from the vertical probe for $K_H$ and the horizontal probe for $K_V$.

When the aspect ratio of the probe aperture decreases in value, the error propagated also decreases. For example, if $l_s/l_l$ equals 0.01 and M equals 0.47 (corresponding to the same anisotropy as in the previous example), then Table 2 (FIG. 13) gives for the vertical probe $3.15 \leqq K_{H1} \leqq 3.30$, or, $3.22\pm 2.2\%$ error, and $0.24 \leqq K_{V1} \leqq 0.43$, or, $0.33\pm 29.3\%$ error, and for the horizontal probe $6.20 \leqq K_{H2} \leqq 7.88$, or $7.04\pm 11.9\%$ error, and $0.56 \leqq K_{V2} \leqq 0.83$, or, $0.70\pm 19\%$ error. Again, the most accurate determination of $K_H$ and $K_V$ consists of using the results from the vertical probe for $K_H$ and the horizontal probe for $K_V$. Note the improvement in accuracy by using a probe with a smaller aspect ratio.

Figure 16:
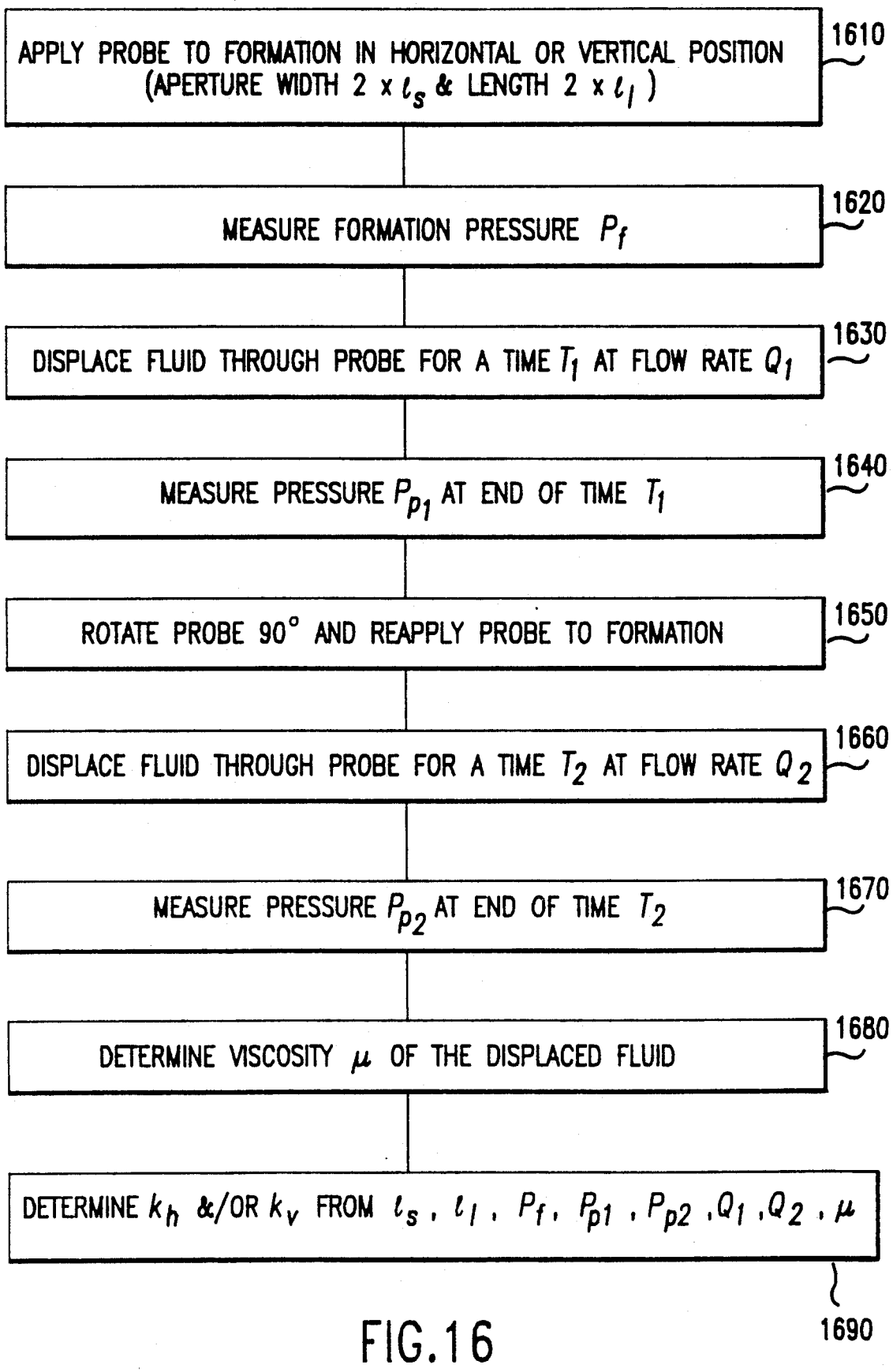
FIG. 16 is a flow chart of a preferred method for determining horizontal and/or vertical permeability in accordance with the invention.
Figure 17:
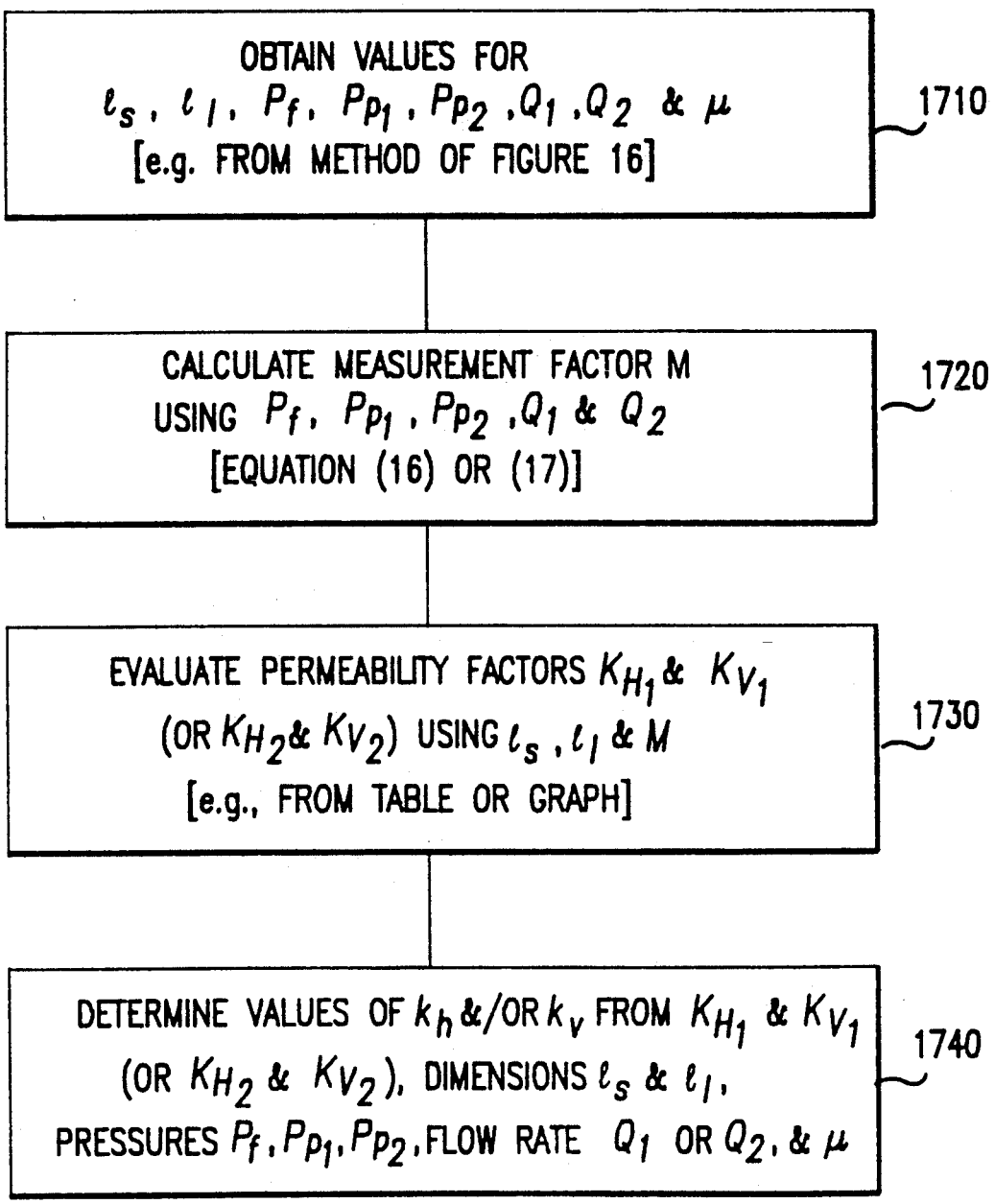
FIG. 17 is a flow chart of a preferred method for determining horizontal and/or vertical permeability in accordance with the invention.

Flow charts of preferred methods in accordance with the invention are given in FIGS. 16 and 17. The probe is applied to the formation (or formation sample) with the aperture oriented in a first direction, preferably either horizontal or vertical (step 1610). The formation pressure is measured at the probe (step 1620). Fluid is displaced through the probe for a first time period at a flow rate $Q_1$ (step 1630). Pressure at the probe is measured at the end of the first time period (step 1640). The probe is then withdrawn, rotated 90°, and reapplied to the formation (step 1650). Fluid is displaced through the probe for a second time period at a flow rate $Q_2$ (step 1660). Pressure at the probe is measured at the end of the second time period (step 1670). Viscosity of the fluid is measured (step 1680). Values of horizontal permeability $k_h$ and/or $k_v$ are determined from the aperture dimensions, the measured pressures, the flow rates, and the fluid viscosity.

A preferred embodiment of determining horizontal and/or vertical permeability values (e.g., of performing step 1690) is shown in FIG. 17. Values are obtained for the aperture dimensions, the measured pressures, the flow rates, and the fluid viscosity, such as by the method of FIG. 16 (step 1710). A value for measurement factor M is calculated using the measured pressures and the flow rates (step 1720). Permeability factors $K_{H1}$ and $K_{V1}$ (or $K_{H2}$ and $K_{V2}$) are evaluated using the aperture dimensions and the value for measurement factor M (step 1730). Values of $k_h$ and/or $k_v$ are determined from the permeability factors, the aperture dimensions, the measured pressures, one or both of the flow rates, $Q_1$ and $Q_2$, and the fluid viscosity.

The steps of FIGS. 16 and 17 need not be carried out in the precise order given. For example, the formation pressure may be measured at the probe at any suitable stage in the process, or may be measured at a separate probe. The viscosity of the displaced fluid may be determined at any time prior to determining values for $k_h$ and/or $k_v$, by testing of a sample or by estimation or otherwise.

Other aperture shapes may be used, such as that of a rectangle. For this case an approximate solution to the boundary value problem has been obtained. Instead of assuming that the pressure of the fluid takes on a constant value at the aperture, it is assumed that the velocity of the fluid leaving the formation is the same at every point of the aperture. Expressions have been derived relating Q, $\mu$, $k_h$, $k_v$, and $\bar{P}_p-P_f$ for the probe oriented both vertically and horizontally with respect to the formation (formation sample) with an aperture having dimensions $2\times l_s$ by $2\times l_l$, where $\bar{P}_p$ denotes the average pressure over the aperture (see H. S. CARSLAW et al., CONDUCTION OF HEAT IN SOLIDS, Oxford Science Publications (1959)). They are $$K_{H1} = \frac{2}{\pi}\sqrt{\frac{1}{2}\left(1+\frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3}-\left(1+\frac{K_{H1}l_l^2}{K_{V1}l_s^2}\right)^{3/2}\right]\right\}, \quad (19)$$

$$\frac{K_{H1}}{M} = \frac{2}{\pi}\sqrt{\frac{1}{2}\left(1+\frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3}-\left(1+\frac{K_{H1}l_s^2}{K_{V1}l_l^2}\right)^{3/2}\right]\right\}, \quad (20)$$

where the definitions of $K_{H1}$, $K_{V1}$, $K_{H2}$, $K_{V2}$, M and $r_p$ are the same as in the case of the elliptically-shaped aperture, with the exception that $\bar{P}_p-P_f$ takes the place of $P_p-P_f$. For liquids:

$$K_{H1} = \frac{4r_p(\bar{P}_{p1}-P_f)k_h}{Q_1\mu};\ K_{V1} = \frac{4r_p(\bar{P}_{p1}-P_f)k_v}{Q_1\mu}; \quad (21)$$

$$K_{H2} = \frac{4r_p(\bar{P}_{p2}-P_f)k_h}{Q_2\mu};\ K_{V2} = \frac{4r_p(\bar{P}_{p2}-P_f)k_v}{Q_2\mu}; \quad (22)$$

and $$M = \frac{Q_2(\bar{P}_{p1}-P_f)}{Q_1(\bar{P}_{p2}-P_f)}. \quad (23)$$

For gases:

$$K_{H1} = \frac{4r_p[(\bar{P}_{p1}^2-P_f^2)/2\bar{P}_{p1}]k_h}{Q_1\mu};\ K_{V1} = \frac{4r_p[(\bar{P}_{p1}^2-P_f^2)/2\bar{P}_{p1}]k_v}{Q_1\mu}; \quad (24)$$

$$K_{H2} = \frac{4r_p[(\bar{P}_{p2}^2-P_f^2)/2\bar{P}_{p2}]k_h}{Q_2\mu};\ K_{V2} = \frac{4r_p[(\bar{P}_{p2}^2-P_f^2)/2\bar{P}_{p2}]k_v}{Q_2\mu}; \quad (25)$$

and $$M = \frac{Q_2(\bar{P}_{p1}^2-P_f^2)\bar{P}_{p2}}{Q_1(\bar{P}_{p2}^2-P_f^2)\bar{P}_{p1}}. \quad (26)$$

Figure 19:
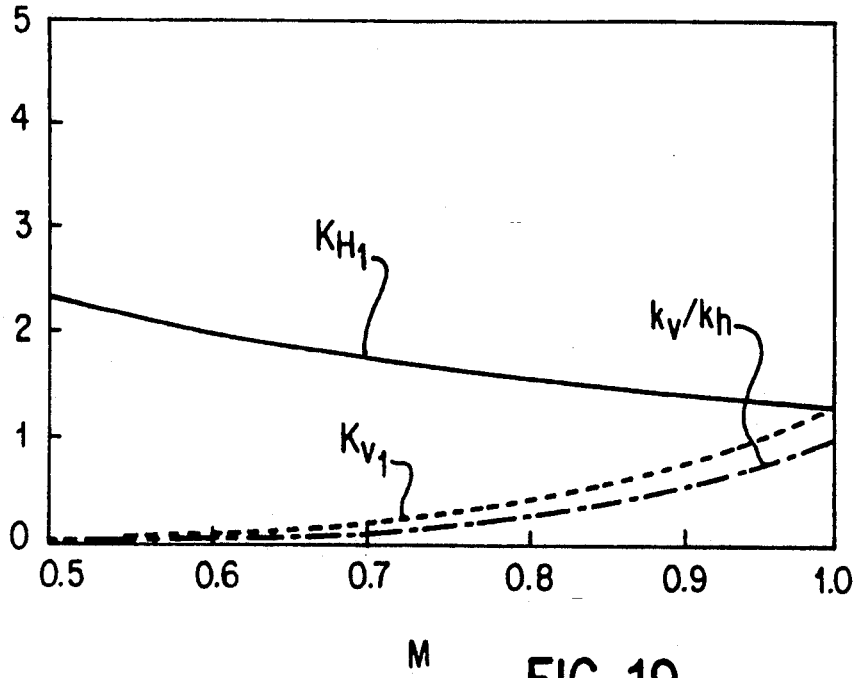
FIG. 19 is a graphic representation of the data presented in the first, second, third and sixth columns of the table of FIG. 18.
Figure 20:
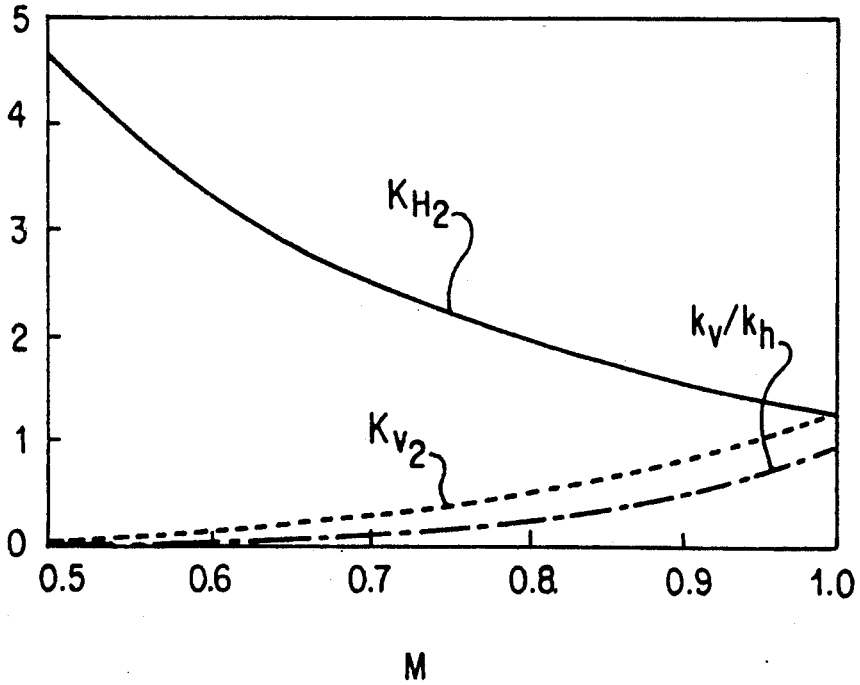
FIG. 20 is a graphic representation of the data presented in the first, fourth, fifth and sixth columns of the table of FIG. 18.

Simultaneous equations (19) and (20) can be solved using the same technique as before. For example, the variables M, $K_{H1}$, $K_{V1}$, $K_{H2}$, and $K_{V2}$ have been evaluated over a range of values of $k_h/k_v$ for a rectangular aperture with aspect ratio equal to 0.2. The data are given in Table 3 of FIG. 18, and presented graphically in FIGS. 19 and 20. Note the similarity between Table 1 (FIG. 10) and Table 3 (FIG. 18).

Probe apertures of different shapes may be used for the two pressure disturbance measurements (e.g., drawdowns). One of the two probe apertures may be circular. For example, assume that probe 1 has a circular aperture of radius $r_{p1}$ and that probe 2 has an elliptical aperture of known aspect ration $l_s/l_l$ oriented horizontally with respect to the formation (or formation sample). The relevant relationships follow from the results for the elliptical aperture. They are $$K_{H1} = \frac{2}{\pi}F\left(\frac{\pi}{2}, \sqrt{1-\frac{K_{V1}}{K_{H1}}}\right) \quad (27)$$

$$\frac{K_{H1}}{M} = \begin{cases} \dfrac{2r_{p2}}{\pi l_s}F\left(\dfrac{\pi}{2}, \left(1-\dfrac{K_{V1}l_l^2}{K_{H1}l_s^2}\right)^{\frac{1}{2}}\right) & \text{for } \dfrac{K_{V1}l_l^2}{K_{H1}l_s^2} \leqq 1 \\ \dfrac{2r_{p2}K_{H1}^{\frac{1}{2}}}{\pi l_l K_{V1}^{\frac{1}{2}}}F\left(\dfrac{\pi}{2}, \left(1-\dfrac{K_{H1}l_s^2}{K_{V1}l_l^2}\right)^{\frac{1}{2}}\right) & \text{for } \dfrac{K_{V1}l_l^2}{K_{H1}l_s^2} > 1. \end{cases} \quad (28)$$

For liquids:

$$K_{H1} = \frac{4r_{p1}(P_{p1}-P_f)k_h}{Q_1\mu};\ K_{V1} = \frac{4r_{p1}(P_{p1}-P_f)k_v}{Q_1\mu}; \quad (29)$$

$$K_{H2} = \frac{4r_{p2}(P_{p2}-P_f)k_h}{Q_2\mu};\ K_{V2} = \frac{4r_{p2}(P_{p2}-P_f)k_v}{Q_2\mu}; \quad (30)$$

For gases:

$$K_{H1} = \frac{4r_{p1}[(P_{p1}^2-P_f^2)/2P_{p1}]k_h}{Q_1\mu};\ K_{V1} = \frac{4r_{p1}[(P_{p1}^2-P_f^2)/2P_{p1}]k_v}{Q_1\mu}; \quad (31)$$

$$K_{H2} = \frac{4r_{p2}[(P_{p2}^2-P_f^2)/2P_{p2}]k_h}{Q_2\mu};\ K_{V2} = \frac{4r_{p2}[(P_{p2}^2-P_f^2)/2P_{p2}]k_v}{Q_2\mu}. \quad (32)$$

The value $r_{p2}$ for the elliptical aperture is given by:

$$r_{p2} = \sqrt{(l_s^2/2 + l_l^2/2}. \quad (33)$$

Figure 22:
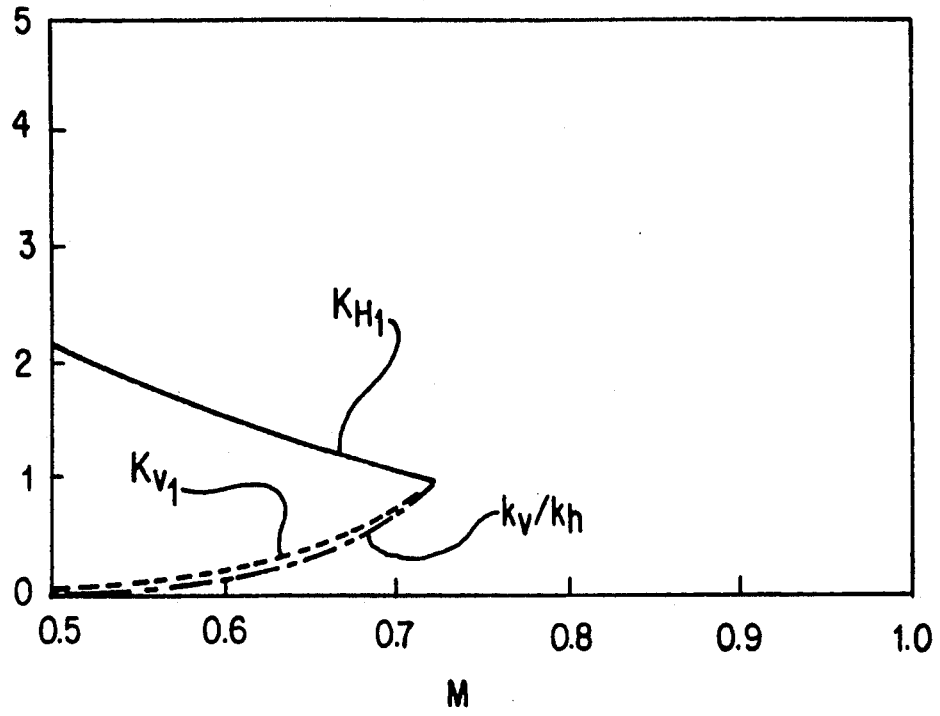
FIG. 22 is a graphic representation of the data presented in the first, second, third and sixth columns of the table of FIG. 21.
Figure 23:
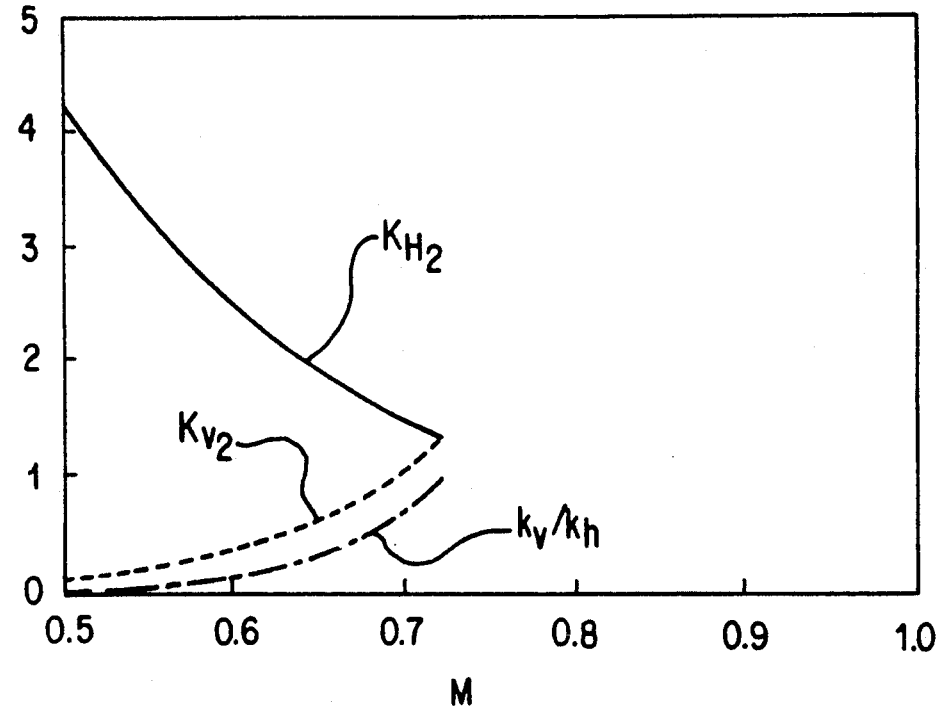
FIG. 23 is a graphic representation of the data presented in the first, fourth, fifth and sixth columns of the table of FIG. 21.

A solution to simultaneous equations 27 and 28 can be obtained using the same method as described in the above examples. Table 4 of FIG. 21 contains evaluations of M, $K_{H1}$, $K_{V1}$, $K_{H2}$, and $K_{V2}$ over a range of values of $k_h/k_v$ for the case of a circular aperture and a horizontal elliptical aperture with aspect ratio $l_s/l_l$ equal to 0.2. These results are illustrated graphically in FIGS. 22 and 23.

While the foregoing describes and illustrates particular preferred embodiments of the invention, it will be understood that many modifications may be made without departing from the spirit of the invention. For example, it may be possible to use a first elongate shaped probe having width $2\times l_{s1}$ and length $l_{l1}$. Then, during the second sampling in an orthogonal, second direction, a second elongate probe having width $2\times l_{s2}$ and length $l_{l2}$ is used. The two probes may differ in their overall dimensions. However, the mathematical interpretation is equivalent. The preferred embodiment presumes that the dimensions are the same for simplicity. Also, it may be possible to have a rectangular shaped probe instead of the elliptical shaped probe during the second sampling, while having a circular probe during the first sampling or vice versa. We intend the following claims to cover any such modifications as fall within the true spirit and scope of the invention.

What is claimed is:

1. A method of estimating permeability of an earth formation in at least one of two orthogonal directions, the formation containing a formation fluid, comprising the steps of:

a. measuring a pressure $P_f$ of the formation fluid;

b. creating a pressure disturbance in the formation fluid by displacing fluid through a probe aperture for a first time period at a first flow rate $Q_1$, the probe aperture having an elongate cross-section of width $2\times l_s$ and length $2\times l_l$ and being oriented in a first direction;

c. measuring a pressure $P_{p1}$ of the fluid substantially at the end of the first time period;

d. creating a pressure disturbance in the formation fluid by displacing fluid through a probe aperture for a second time period at a second rate $Q_2$, the probe aperture having an elongate cross-section of width $2\times l_s$ and length $2\times l_l$ and being oriented in a second direction orthogonal to said first direction;

e. measuring a pressure $P_{p2}$ of the fluid substantially at the end of the second time period;

f. determining a value $\mu$ for viscosity of fluid in the formation; and g. determining a value of permeability in at least one of said first and second directions from the aperture width $2\times l_s$ and the aperture length $2\times l_l$, the measured pressure $P_f$, at least one of measured pressures $P_{p1}$ and $P_{p2}$, at least one of the flow rates $Q_1$ and $Q_2$, and the determined value $\mu$ for viscosity of fluid in the formation.

2. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{Hi}$ representative of the horizontal permeability of the formation and a value of a dimensionless quantity $K_V$ representative of the vertical permeability of the formation, based on the calculated measurement factor M and the aperture width $2\times l_s$ and the aperture length $2\times l_l$; and iii. determining a horizontal permeability value $k_h$ from the values of quantity $K_{Hi}$, the aperture width $2\times l_s$ and the aperture length $2\times l_l$, the measured pressure $P_f$, at least one of measured pressures $P_{p1}$ and $P_{p2}$, at least one of flow rates $Q_1$ and $Q_2$, and the determined value $\mu$ for viscosity of fluid in the formation.

3. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{H1}$ representative of the horizontal permeability of the formation and a value of a dimensionless quantity $K_V$ representative of the vertical permeability of the formation, based on the calculated measurement factor M and the aperture width $2\times l_s$ and the aperture length $2\times l_l$; and iii. determining a horizontal permeability value $k_h$ from the values of quantity $K_{H1}$, the aperture width $2\times l_s$ and the aperture length $2\times l_l$, the measured pressure $P_f$, the measured pressure $P_{p1}$, the flow rate $Q_1$, and the determined value $\mu$ for viscosity of fluid in the formation.

4. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{H2}$ representative of the horizontal permeability of the formation and a value of a dimensionless quantity $K_V$ representative of the vertical permeability of the formation, based on the calculated measurement factor M and the aperture width $2\times l_s$ and the aperture length $2\times l_l$; and iii. determining a horizontal permeability value $k_h$ from the values of quantity $K_{H2}$, the aperture width $2\times l_s$ and the aperture length $2\times l_l$, the measured pressure $P_f$, the measured pressure $P_{p2}$, the flow rate $Q_2$, and the determined value $\mu$ for viscosity of fluid in the formation.

5. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{Vi}$ representative of the vertical permeability of the formation, based on the calculated measurement factor M and the aperture width $2\times l_s$ and the aperture length $2\times l_l$; and iii. determining a vertical permeability value $k_v$ from the values of quantity $K_{Vi}$, the aperture width $2\times l_s$ and the aperture length $2\times l_l$, the measured pressure $P_f$, at least one of measured pressures $P_{p1}$ and $P_{p2}$, at least one of flow rates $Q_1$ and $Q_2$, and the determined value $\mu$ for viscosity of fluid in the formation.

6. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$; and iii. determining a vertical permeability value $k_v$ from the values of quantity $K_{V1}$, the aperture width $2\times l_s$ and the aperture length $2\times l_l$, the measured pressure $P_f$, the measured pressure $P_{p1}$, the flow rate $Q_1$, and the determined value $\mu$ for viscosity of fluid in the formation.

7. The method of claim 1, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{V2}$ representative of the vertical permeability of the formation, based on the calculated measurement factor M and the aperture width $2\times l_s$ and the aperture length $2\times l_l$; and iii. determining a vertical permeability value $k_v$ from the values of quantity $K_{V2}$, the aperture width $2\times l_s$ and the aperture length $2\times l_l$, the measured pressure $P_f$, the measured pressure $P_{p2}$, the flow rate $Q_2$, and the determined value $\mu$ for viscosity of fluid in the formation.

8. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a horizontal permeability value $k_h$ from the values of a quantity $K_{Hi}$ comprising one of the quantities $K_{H1}$ and $K_{H1}/M$, the aperture width $2\times l_s$ and the aperture length $2\times l_l$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationships $$K_{Hi} = \frac{4r_p(P_{pj} - P_f)k_h}{Q_n \mu},$$

$$r_p = \sqrt{l_s^2/2 + l_l^2/2}.$$

9. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a horizontal permeability value $k_h$ from the values of quantity $K_{H1}$, the aperture width $2\times l_s$ and the aperture length $2\times l_l$, the measured pressure $P_f$, the measured pressure $P_{p1}$, the flow rate $Q_1$, and the determined value $\mu$ for viscosity of fluid in the formation in accordance with the relationships $$K_{H1} = \frac{4r_p(\bar{P}_{p1} - P_f)k_h}{Q_1\mu},$$

$$r_p = \sqrt{l_s^2/2 + l_l^2/2}.$$

10. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1}l_s^2}{K_{H1}l_l^2}\right)^{\frac{1}{2}}\right) \text{for } \frac{K_{V1}l_s^2}{K_{H1}l_l^2} \leqq 1 \\ \frac{2r_pK_{H1}^{\frac{1}{2}}}{\pi l_sK_{V1}^{\frac{1}{2}}} F\left(\frac{\pi}{2}, \left(1 - \frac{K_{H1}l_l^2}{K_{V1}l_s^2}\right)^{\frac{1}{2}}\right) \text{for } \frac{K_{V1}l_s^2}{K_{H1}l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1}l_l^2}{K_{H1}l_s^2}\right)^{\frac{1}{2}}\right) \text{for } \frac{K_{V1}l_l^2}{K_{H1}l_s^2} \leqq 1 \\ \frac{2r_pK_{H1}^{\frac{1}{2}}}{\pi l_lK_{V1}^{\frac{1}{2}}} F\left(\frac{\pi}{2}, \left(1 - \frac{K_{H1}l_s^2}{K_{V1}l_l^2}\right)^{\frac{1}{2}}\right) \text{for } \frac{K_{V1}l_l^2}{K_{H1}l_s^2} > 1, \end{cases}$$

$$r_p = \sqrt{l_s^2/2 + l_l^2/2};$$

where F denotes the complete elliptic integral of the first kind;

iii. determining a horizontal permeability value $k_h$ from the values of quantity $K_{H1}/M$, the aperture width $2\times l_s$ and the aperture length $2\times l_l$, the measured pressure $P_f$, the measured pressure $P_{p2}$, the flow rate $Q_2$, and the determined value $\mu$ for viscosity of fluid in the formation in accordance with the relationships $$\frac{K_{H1}}{M} = \frac{4r_p(\bar{P}_{p2} - P_f)k_h}{Q_2\mu},$$

$$r_p = \sqrt{l_s^2/2 + l_l^2/2}.$$

11. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1}l_s^2}{K_{H1}l_l^2}\right)^{\frac{1}{2}}\right) \text{for } \frac{K_{V1}l_s^2}{K_{H1}l_l^2} \leqq 1 \\ \frac{2r_pK_{H1}^{\frac{1}{2}}}{\pi l_sK_{V1}^{\frac{1}{2}}} F\left(\frac{\pi}{2}, \left(1 - \frac{K_{H1}l_l^2}{K_{V1}l_s^2}\right)^{\frac{1}{2}}\right) \text{for } \frac{K_{V1}l_s^2}{K_{H1}l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1}l_l^2}{K_{H1}l_s^2}\right)^{\frac{1}{2}}\right) \text{for } \frac{K_{V1}l_l^2}{K_{H1}l_s^2} \leqq 1 \\ \frac{2r_pK_{H1}^{\frac{1}{2}}}{\pi l_lK_{V1}^{\frac{1}{2}}} F\left(\frac{\pi}{2}, \left(1 - \frac{K_{H1}l_s^2}{K_{V1}l_l^2}\right)^{\frac{1}{2}}\right) \text{for } \frac{K_{V1}l_l^2}{K_{H1}l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the values of a quantity $K_{Vi}$ comprising one of quantities $K_{V1}$ and $K_{V1}/M$, the aperture width $2\times l_s$ and the aperture length $2\times l_l$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationships $$K_{Vi} = \frac{4r_p(\bar{P}_{pj} - P_f)k_v}{Q_n\mu},$$

$$r_p = \sqrt{l_s^2/2 + l_l^2/2}.$$

12. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1} - P_f)}{Q_1(\bar{P}_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the values of quantity $K_{V1}$, the aperture width $2\times l_s$ and the aperture length $2\times l_l$, the measured pressure $P_f$, the measured pressure $P_{p1}$, the flow rate $Q_1$, and the determined value $\mu$ for viscosity of fluid in the formation in accordance with the relationships $$K_{V1} = \frac{4r_p(\bar{P}_{p1} - P_f)k_v}{Q_1\mu},$$

$$r_p = \sqrt{l_s^2/2 + l_l^2/2}.$$

13. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1} - P_f)}{Q_1(\bar{P}_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the values of quantity $K_{V1}/M$, the aperture width $2\times l_s$ and the aperture length $2\times l_l$, the measured pressure $P_f$, the measured pressure $P_{p2}$, the flow rate $Q_2$, and the determined value $\mu$ for viscosity of fluid in the formation in accordance with the relationships $$\frac{K_{V1}}{M} = \frac{4r_p(\bar{P}_{p2} - P_f)k_v}{Q_2\mu},$$

$$r_p = \sqrt{l_s^2/2 + l_l^2/2}.$$

14. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1}^2 - P_f^2)P_{p2}}{Q_1(\bar{P}_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2\times l_s$ and the aperture length $2\times l_l$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a horizontal permeability value $k_h$ from the values of a quantity $K_{Hi}$ comprising one of the quantities $K_{H1}$ and $K_{H1}/M$, the aperture width $2 \times l_s$ and the aperture length $2 \times l_1$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationships $$K_{Hi} = \frac{4r_p[(P_{pj}^2 - P_f^2)/2P_{pj}]k_h}{Q_n \mu},$$

$$r_p = \sqrt{l_s^2/2 + l_l^2/2}\ .$$

15. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1}^2 - P_f^2)P_{p2}}{Q_1(\bar{P}_{p2}^2 - P_f^2)P_{p1}}.$$

ii. determining a value of a dimensionless quantity $K_{H1}$ representative of the horizontal permeability of the formation and a value of a dimensionless quantity $K_{v1}$ representative of the vertical permeability of the formation, based on the calculated measurement factor M and the aperture width $2 \times l_s$ and the aperture length $2 \times l_1$ in accordance with the relationships $$K_{H1} = \begin{cases} \frac{2r_p}{\pi l_l} F\left(\frac{\pi}{2}, \left(1 - \frac{K_{V1} l_s^2}{K_{H1} l_l^2}\right)^{\frac{1}{2}}\right) \text{for } \frac{K_{V1} l_s^2}{K_{H1} l_l^2} \leqq 1 \\ \frac{2r_p K_{H1}^{\frac{1}{2}}}{\pi l_s K_{V1}^{\frac{1}{2}}} F\left(\frac{\pi}{2}, \left(1 - \frac{K_{H1} l_l^2}{K_{V1} l_s^2}\right)^{\frac{1}{2}}\right) \text{for } \frac{K_{V1} l_s^2}{K_{H1} l_l^2} > 1, \end{cases}$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a horizontal permeability value $k_h$ from the values of quantity $K_{H1}$, the aperture width $2 \times l_s$ and the aperture length $2 \times l_1$, the measured pressure $P_f$, the measured pressure $P_{p1}$, the flow rate $Q_1$, and the determined value $\mu$ for viscosity of fluid in the formation in accordance with the relationships $$K_{H1} = \frac{4r_p[(P_{p1}^2 - P_f^2)/2P_{p1}]k_h}{Q_1 \mu},$$

$$r_p = \sqrt{l_s^2/2 + l_l^2/2}\ .$$

16. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1}^2 - \bar{P}_f^2)P_{p2}}{Q_1(\bar{P}_{p2}^2 - \bar{P}_f^2)P_{p1}}.$$

ii. determining a value of a dimensionless quantity $K_{H1}$ representative of the horizontal permeability of the formation and a value of a dimensionless quantity $K_{v1}$ representative of the vertical permeability of the formation, based on the calculated measurement factor M and the aperture width $2 \times l_s$ and the aperture length $2 \times l_1$ in accordance with the relationships $$K_{H1} = \begin{cases} \dfrac{2r_p}{\pi l_l} F\left(\dfrac{\pi}{2}, \left(1 - \dfrac{K_{V1} l_s^2}{K_{H1} l_l^2}\right)^{\frac{1}{2}}\right) \text{for } \dfrac{K_{V1} l_s^2}{K_{H1} l_l^2} \leqq 1 \\ \dfrac{2r_p K_{H1}^{\frac{1}{2}}}{\pi l_s K_{V1}^{\frac{1}{2}}} F\left(\dfrac{\pi}{2}, \left(1 - \dfrac{K_{H1} l_l^2}{K_{V1} l_s^2}\right)^{\frac{1}{2}}\right) \text{for } \dfrac{K_{V1} l_s^2}{K_{H1} l_l^2} > 1, \end{cases}$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a horizontal permeability value $k_h$ from the values of quantity $K_{H1}/M$, the aperture width $2 \times l_s$ and the aperture length $2 \times l_1$, the measured pressure $P_f$, the measured pressure $P_{p2}$, the flow rate $Q_2$, and the determined value $\mu$ for viscosity of fluid in the formation in accordance with the relationships $$\frac{K_{H1}}{M} = \frac{4r_p[(\bar{P}_{p2}^2 - P_f^2)/2\bar{P}_{p2}]k_h}{Q_2\mu},$$

$$r_p = \sqrt{l_s^2/2 + l_l^2/2}\ .$$

17. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1}^2 - P_f^2)\bar{P}_{p2}}{Q_1(\bar{P}_{p2}^2 - P_f^2)\bar{P}_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2 \times l_s$ and the aperture length $2 \times l_l$ in accordance with the relationships $$K_{H1} = \begin{cases} \dfrac{2r_p}{\pi l_l} F\left(\dfrac{\pi}{2}, \left(1 - \dfrac{K_{V1} l_s^2}{K_{H1} l_l^2}\right)^{\frac{1}{2}}\right) \text{for } \dfrac{K_{V1} l_s^2}{K_{H1} l_l^2} \leqq 1 \\ \dfrac{2r_p K_{H1}^{\frac{1}{2}}}{\pi l_s K_{V1}^{\frac{1}{2}}} F\left(\dfrac{\pi}{2}, \left(1 - \dfrac{K_{H1} l_l^2}{K_{V1} l_s^2}\right)^{\frac{1}{2}}\right) \text{for } \dfrac{K_{V1} l_s^2}{K_{H1} l_l^2} > 1, \end{cases}$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a vertical permeability value $k_v$ from the values of quantity $K_{Vi}$ comprising one of quantities $K_{V1}$ and $K_{V1}/M$, the aperture width $2 \times l_s$ and the aperture length $2 \times l_l$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationships $$K_{Vi} = \frac{4r_p[(P_{pj}^2 - P_f^2)/2P_{pj}]k_v}{Q_n\mu},$$

$$r_p = \sqrt{l_s^2/2 + l_l^2/2}\ .$$

18. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(\bar{P}_{p1}^2 - P_f^2)\bar{P}_{p2}}{Q_1(\bar{P}_{p2}^2 - P_f^2)\bar{P}_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2 \times l_s$ and the aperture length $2 \times l_l$ in accordance with the relationships $$K_{H1} = \begin{cases} \dfrac{2r_p}{\pi l_l} F\left(\dfrac{\pi}{2}, \left(1 - \dfrac{K_{V1} l_s^2}{K_{H1} l_l^2}\right)^{\frac{1}{2}}\right) \text{for } \dfrac{K_{V1} l_s^2}{K_{H1} l_l^2} \leqq 1 \\ \dfrac{2r_p K_{H1}^{\frac{1}{2}}}{\pi l_s K_{V1}^{\frac{1}{2}}} F\left(\dfrac{\pi}{2}, \left(1 - \dfrac{K_{H1} l_l^2}{K_{V1} l_s^2}\right)^{\frac{1}{2}}\right) \text{for } \dfrac{K_{V1} l_s^2}{K_{H1} l_l^2} > 1, \end{cases}$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a vertical permeability value $k_v$ from the values of quantity $K_{V1}$, the aperture width $2 \times l_s$ and the aperture length $2 \times l_l$, the measured pressure $P_f$, the measured pressure $P_{p1}$, the flow rate $Q_1$, and the determined value $\mu$ for viscosity of fluid in the formation in accordance with the relationships $$K_{V1} = \frac{4r_p[(P_{p1}^2 - P_f^2)/2P_{p1}]k_v}{Q_1 \mu},$$

$$r_p = \sqrt{l_s^2/2 + l_l^2/2}\ .$$

19. The method of claim 1, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture width $2 \times l_s$ and the aperture length $2 \times l_l$ in accordance with the relationships $$K_{H1} = \begin{cases} \dfrac{2r_p}{\pi l_l} F\left(\dfrac{\pi}{2}, \left(1 - \dfrac{K_{V1} l_s^2}{K_{H1} l_l^2}\right)^{\frac{1}{2}}\right) \text{for } \dfrac{K_{V1} l_s^2}{K_{H1} l_l^2} \leqq 1 \\ \dfrac{2r_p K_{H1}^{\frac{1}{2}}}{\pi l_s K_{V1}^{\frac{1}{2}}} F\left(\dfrac{\pi}{2}, \left(1 - \dfrac{K_{H1} l_l^2}{K_{V1} l_s^2}\right)^{\frac{1}{2}}\right) \text{for } \dfrac{K_{V1} l_s^2}{K_{H1} l_l^2} > 1, \end{cases}$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2}\ ;$$

where F denotes the complete elliptic integral of the first kind;

iii. determining a vertical permeability value $k_v$ from the values of quantity $K_{V1}/M$, the aperture width $2 \times l_s$ and the aperture length $2 \times l_l$, the measured pressure $P_f$, the measured pressure $P_{p2}$, the flow rate $Q_2$, and the determined value $\mu$ for viscosity of fluid in the formation in accordance with the relationships $$\frac{K_{V1}}{M} = \frac{4r_p[(P_{p2}^2 - P_f^2)/2P_{p2}]k_v}{Q_2 \mu},$$

$$r_p = \sqrt{l_s^2/2 + l_l^2/2}\ .$$

20. A method of estimating permeability of an earth formation in at least one of two orthogonal directions, comprising the steps of:

a. measuring a pressure $P_f$ of fluid in the formation;

b. creating a pressure disturbance in the formation fluid by displacing fluid through a probe aperture for a first time period at a first flow rate $Q_1$, the probe aperture having an elongate cross-section of width $2 \times l_s$ and length $2 \times l_l$ and being oriented in a first direction;

c. measuring pressure of the fluid substantially at the end of the first time period to obtain a value $\overline{P}_{p1}$ of average pressure over the aperture;

d. creating a pressure disturbance in the formation fluid by displacing fluid through a probe aperture for a second time period at a second rate $Q_2$, the probe aperture having an elongate cross-section of width $2 \times l_s$ and length $2 \times l_l$ and being oriented in a second direction orthogonal to said first direction;

e. measuring pressure of the fluid substantially at the end of the second time period to obtain a value $\overline{P}_{p2}$ of average pressure over the aperture;

f. determining a value $\mu$ for viscosity of fluid in the formation; and g. determining a value of permeability in at least one of two orthogonal directions from the aperture width $2\times l_s$ and the aperture length $2\times l_l$, the measured pressure $P_f$, at least one of the average pressure values $\overline{P}_{p1}$ and $\overline{P}_{p2}$, at least one of the flow rates $Q_1$ and $Q_2$, and the determined value $\mu$ for viscosity of fluid in the formation.

21. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_{Hi}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$;

iii. determining a horizontal permeability value $k_h$ from the values of quantity $K_{Hi}$, the aperture dimensions $2\times l_s$ and $2\times l_l$, the measured pressure $P_f$, at least one of the average pressure values $\overline{P}_{p1}$ and $\overline{P}_{p2}$, at least one of the flow rates $Q_1$ and $Q_2$, and the determined value $\mu$ for viscosity of fluid in the formation.

22. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$;

iii. determining a horizontal permeability value $k_h$ from the values of quantity $K_{H1}$, the aperture dimensions $2\times l_s$ and $2\times l_l$, the measured pressure $P_f$, the average pressure value $\overline{P}_{p1}$, the flow rate $Q_1$, and the determined value $\mu$ for viscosity of fluid in the formation.

23. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_{H2}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$;

iii. determining a horizontal permeability value $k_h$ from the values of quantity $K_{H2}$, the aperture dimensions $2\times l_s$ and $2\times l_l$, the measured pressure $P_f$, the average pressure value $\overline{P}_{p2}$, the flow rate $Q_2$, and the determined value $\mu$ for viscosity of fluid in the formation.

24. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_H$ representative of the horizontal permeability of the formation and a value of a dimensionless quantity $K_{Vi}$ representative of the vertical permeability of the formation, based on the calculated measurement factor M and the aperture dimensions $2\times l_s$ and $2\times l_l$;

iii. determining a vertical permeability value $k_v$ from the values of quantity $K_{Vi}$, the aperture dimensions $2\times l_s$ and $2\times l_l$, the measured pressure $P_f$, at least one of the average pressure values $\overline{P}_{p1}$ and $\overline{P}_{p2}$, at least one of the flow rates $Q_1$ and $Q_2$, and the determined value $\mu$ for viscosity of fluid in the formation.

25. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_H$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$;

iii. determining a vertical permeability value $k_v$ from the values of quantity $K_{V1}$, the aperture dimensions $2\times l_s$ and $2\times l_l$, the measured pressure $P_f$, the average pressure value $\overline{P}_{p1}$, the flow rate $Q_1$, and the determined value $\mu$ for viscosity of fluid in the formation.

26. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$;

ii. determining a value of a dimensionless quantity $K_H$ representative of the horizontal permeability of the formation and a value of a dimensionless quantity $K_{V2}$ representative of the vertical permeability of the formation, based on the calculated measurement factor M and the aperture dimensions $2\times l_s$ and $2\times l_l$;

iii. determining a vertical permeability value $k_v$ from the values of quantity $K_{V2}$, the aperture dimensions $2\times l_s$ and $2\times l_l$, the measured pressure $P_f$, the average pressure value $\overline{P}_{p2}$, the flow rate $Q_2$, and the determined value $\mu$ for viscosity of fluid in the formation.

27. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(\overline{P}_{p1} - \overline{P}_f)}{Q_1(\overline{P}_{p2} - \overline{P}_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1+\frac{l_s^2}{l_l^2)}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3} - \left(1+\frac{K_{H1}l_l^2}{K_{V1}l_s^2)}\right)^{3/2}\right]\right\},$$

$$\frac{K_{H1}}{M} = \frac{2}{\pi}\sqrt{\frac{1}{2}\left(1+\frac{l_l^2}{l_s^2)}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3} - \left(1+\frac{K_{H1}l_s^2}{K_{V1}l_l^2)}\right)^{3/2}\right]\right\};$$

iii. determining a horizontal permeability value $k_h$ from the value of a quantity $K_{Hi}$ comprising one of the values $K_{H1}$ and $K_{H1}/M$, the aperture dimensions $2\times l_s$ and $2\times l_l$, the measured pressure $P_f$, a pressure value $\overline{P}_{pj}$ comprising one of the average pressure values $\overline{P}_{p1}$ and $\overline{P}_{p2}$, a flow rate $Q_n$ comprising one of the flow rates $Q_1$ and $Q_2$, and the determined value $\mu$ for viscosity of fluid in the formation in accordance with the relationships $$K_{Hi} = \frac{4r_p(\overline{P}_{pj} - \overline{P}_f)k_h}{Q_n\mu},$$

$$r_p = \sqrt{l_s^2/2 + l_l^2/2}.$$

28. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1+\frac{l_s^2}{l_l^2)}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} +$$

-continued $$\sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3} - \left(1+\frac{K_{H1}l_l^2}{K_{V1}l_s^2)}\right)^{3/2}\right]\right\},$$

$$\frac{K_{H1}}{M} = \frac{2}{\pi}\sqrt{\frac{1}{2}\left(1+\frac{l_l^2}{l_s^2)}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3} - \left(1+\frac{K_{H1}l_s^2}{K_{V1}l_l^2)}\right)^{3/2}\right]\right\};$$

iii. determining a horizontal permeability value $k_h$ from the values of quantity $K_{H1}$, the aperture dimensions $2\times l_s$ and $2\times l_l$, the measured pressure $P_f$, the average pressure value $\overline{P}_{p1}$, the flow rate $Q_1$, and the determined value $\mu$ for viscosity of fluid in the formation in accordance with the relationships $$K_{H1} = \frac{4r_p(\overline{P}_{p1} - \overline{P}_f)k_h}{Q_1\mu},$$

$$r_p = \sqrt{l_s^2/2 + l_l^2/2}.$$

29. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(\overline{P}_{p1} - \overline{P}_f)}{Q_1(\overline{P}_{p2} - \overline{P}_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1+\frac{l_s^2}{l_l^2)}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3} -\right.\right.$$

-continued $$\left(1+\frac{K_{H1}l_l^2}{K_{V1}l_s^2)}\right)^{3/2}\Bigg]\Bigg\},$$

$$\frac{K_{H1}}{M}=\frac{2}{\pi}\sqrt{\frac{1}{2}\left(1+\frac{l_l^2}{l_s^2)}\right)}\Bigg\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+$$

$$\sinh^{-1}\frac{K_{H1}^{\frac{1}{2}}l_s}{K_{V1}^{\frac{1}{2}}l_l}+\frac{K_{V1}^{\frac{1}{2}}l_l}{3K_{H1}^{\frac{1}{2}}l_s}\Bigg[1+\frac{K_{H1}^{3/2}l_s^3}{K_{V1}^{3/2}l_l^3}-$$

$$\left(1+\frac{K_{H1}l_s^2}{K_{V1}l_l^2)}\right)^{3/2}\Bigg]\Bigg\};$$

iii. determining a horizontal permeability value $k_h$ from the values of quantity $K_{H1}/M$, the aperture dimensions $2\times l_{ds}$ $l_l$, the measured pressure $P_f$, the average pressure value $\overline{P}_{p2}$, the flow rate $Q_2$, and the determined value $\mu$ for viscosity of fluid in the formation in accordance with the relationships $$\frac{K_{H1}}{M}=\frac{4r_p(P_{p2}-P_f)k_h}{Q_2\mu},$$

$$r_p=\sqrt{l_s^2/2+l_l^2/2}.$$

30. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M=\frac{Q_2(P_{p1}-P_f)}{Q_1(P_{p2}-P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1}=\frac{2}{\pi}\sqrt{\frac{1}{2}\left(1+\frac{l_s^2}{l_l^2)}\right)}\Bigg\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l}+$$

$$\sinh^{-1}\frac{K_{H1}^{\frac{1}{2}}l_l}{K_{V1}^{\frac{1}{2}}l_s}+\frac{K_{V1}^{\frac{1}{2}}l_s}{3K_{H1}^{\frac{1}{2}}l_l}\Bigg[1+\frac{K_{H1}^{3/2}l_l^3}{K_{V1}^{3/2}l_s^3}-$$

$$\left(1+\frac{K_{H1}l_l^2}{K_{V1}l_s^2)}\right)^{3/2}\Bigg]\Bigg\},$$

-continued $$\frac{K_{H1}}{M}=\frac{2}{\pi}\sqrt{\frac{1}{2}\left(1+\frac{l_l^2}{l_s^2)}\right)}\Bigg\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+$$

$$\sinh^{-1}\frac{K_{H1}^{\frac{1}{2}}l_s}{K_{V1}^{\frac{1}{2}}l_l}+\frac{K_{V1}^{\frac{1}{2}}l_l}{3K_{H1}^{\frac{1}{2}}l_s}\Bigg[1+\frac{K_{H1}^{3/2}l_s^3}{K_{V1}^{3/2}l_l^3}-$$

$$\left(1+\frac{K_{H1}l_s^2}{K_{V1}l_l^2)}\right)^{3/2}\Bigg]\Bigg\};$$

iii. determining a vertical permeability value $k_v$ from the values of a quantity $K_{Vi}$ comprising one of quantities $K_{V1}$ and $K_{V1}/M$, the aperture dimensions $2\times l_s$ and $2\times l_l$, the measured pressure $P_f$, a pressure value $\overline{P}_{pj}$ comprising one of the average pressure values $\overline{P}_{p1}$ and $\overline{P}_{p2}$, a flow rate $Q_n$ comprising one of the flow rates $Q_1$ and $Q_2$, and the determined value $\mu$ for viscosity of fluid in the formation in accordance with the relationships $$K_{Vi}=\frac{4r_p(P_{pj}-P_f)k_v}{Q_n\mu},$$

$$r_p=\sqrt{l_s^2/2+l_l^2/2}.$$

31. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M=\frac{Q_2(P_{p1}-P_f)}{Q_1(P_{p2}-P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1}=\frac{2}{\pi}\sqrt{\frac{1}{2}\left(1+\frac{l_s^2}{l_l^2}\right)}\Bigg\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l}+$$

$$\sinh^{-1}\frac{K_{H1}^{\frac{1}{2}}l_l}{K_{V1}^{\frac{1}{2}}l_s}+$$

$$\frac{K_{V1}^{\frac{1}{2}}l_s}{3K_{H1}^{\frac{1}{2}}l_l}\Bigg[1+\frac{K_{H1}^{3/2}l_l^3}{K_{V1}^{3/2}l_s^3}-\left(1+\frac{K_{H1}l_l^2}{K_{V1}l_s^2}\right)^{3/2}\Bigg]\Bigg\},$$

$$\frac{K_{H1}}{M}=\frac{2}{\pi}\sqrt{\frac{1}{2}\left(1+\frac{l_l^2}{l_s^2}\right)}\Bigg\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+$$

-continued $$\sinh^{-1}\frac{K_{H1}^{\frac{1}{2}}l_s}{K_{V1}^{\frac{1}{2}}l_l}+$$

$$\frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3}-\left(1+\frac{K_{H1}l_s^2}{K_{V1}l_l^2}\right)^{3/2}\right]\Bigg\};$$

iii. determining a vertical permeability value $k_v$ from the values of quantity $K_{V1}$, the aperture dimensions $2\times l_s$ and $2\times l_l$, the measured pressure $P_f$, the average pressure value $\overline{P}_{p1}$, the flow rate $Q_1$, and the determined value $\mu$ for viscosity of fluid in the formation in accordance with the relationships $$K_{V1}=\frac{4r_p(P_{p1}-P_f)k_v}{Q_1\mu},$$

$$r_p=\sqrt{l_s^2/2+l_l^2/2}.$$

32. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M=\frac{Q_2(P_{p1}-P_f)}{Q_1(P_{p2}-P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1}=\frac{2}{\pi}\sqrt{\frac{1}{2}\left(1+\frac{l_s^2}{l_l^2}\right)}\Bigg\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l}+$$

$$\sinh^{-1}\frac{K_{H1}^{\frac{1}{2}}l_l}{K_{V1}^{\frac{1}{2}}l_s}+$$

$$\frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3}-\left(1+\frac{K_{H1}l_l^2}{K_{V1}l_s^2}\right)^{3/2}\right]\Bigg\},$$

$$\frac{K_{H1}}{M}=\frac{2}{\pi}\sqrt{\frac{1}{2}\left(1+\frac{l_l^2}{l_s^2}\right)}\Bigg\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+$$

$$\sinh^{-1}\frac{K_{H1}^{\frac{1}{2}}l_s}{K_{V1}^{\frac{1}{2}}l_l}+$$

$$\frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3}-\left(1+\frac{K_{H1}l_s^2}{K_{V1}l_l^2}\right)^{3/2}\right]\Bigg\};$$

iii. determining a vertical permeability value $k_v$ from the value of quantity $K_{V1}/M$, the aperture dimensions $2\times l_s$ and $2\times l_l$, the measured pressure $P_f$, the average pressure value $\overline{P}_{p2}$, the flow rate $Q_2$, and the determined value $\mu$ for viscosity of fluid in the formation in accordance with the relationships $$\frac{K_{V1}}{M}=\frac{4r_p(P_{p2}-P_f)k_v}{Q_2\mu},$$

$$r_p=\sqrt{l_s^2/2+l_l^2/2}.$$

33. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M=\frac{Q_2(P_{p1}^2-P_f^2)P_{p2}}{Q_1(P_{p2}^2-P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1}=\frac{2}{\pi}\sqrt{\frac{1}{2}\left(1+\frac{l_s^2}{l_l^2}\right)}\Bigg\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l}+$$

$$\sinh^{-1}\frac{K_{H1}^{\frac{1}{2}}l_l}{K_{V1}^{\frac{1}{2}}l_s}+$$

$$\frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3}-\left(1+\frac{K_{H1}l_l^2}{K_{V1}l_s^2}\right)^{3/2}\right]\Bigg\},$$

$$\frac{K_{H1}}{M}=\frac{2}{\pi}\sqrt{\frac{1}{2}\left(1+\frac{l_l^2}{l_s^2}\right)}\Bigg\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+$$

$$\sinh^{-1}\frac{K_{H1}^{\frac{1}{2}}l_s}{K_{V1}^{\frac{1}{2}}l_l}+$$

$$\frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3}-\left(1+\frac{K_{H1}l_s^2}{K_{V1}l_l^2}\right)^{3/2}\right]\Bigg\};$$

iii. determining a horizontal permeability value $k_h$ from the value of a quantity $K_{Hi}$ comprising one of values $K_{H1}$ and $K_{H1}/M$, the aperture dimensions $2\times l_s$ and $2\times l_l$, the measured pressure $P_f$, a pressure value $\overline{P}_{pj}$ comprising one of the average pressure values $\overline{P}_{p1}$ and $\overline{P}_{p2}$, a flow rate $Q_n$ comprising one of the flow rates $Q_1$ and $Q_2$, and the determined value $\mu$ for viscosity of fluid in the formation in accordance with the relationships $$K_{Hi} = \frac{4r_p[(P_{pj}^2 - P_f^2)/2P_{pj}]k_h}{Q_n\mu},$$

$$r_p = \sqrt{l_s^2/2 + l_l^2/2}.$$

34. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1 + \frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1 + \frac{K_{H1}^{3/2}l_l^3}{K_{V1}^{3/2}l_s^3} - \left(1 + \frac{K_{H1}l_l^2}{K_{V1}l_s^2}\right)^{3/2}\right]\right\},$$

$$\frac{K_{H1}}{M} = \frac{2}{\pi}\sqrt{\frac{1}{2}\left(1 + \frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1 + \frac{K_{H1}^{3/2}l_s^3}{K_{V1}^{3/2}l_l^3} - \left(1 + \frac{K_{H1}l_s^2}{K_{V1}l_l^2}\right)^{3/2}\right]\right\};$$

iii. determining a horizontal permeability value $k_h$ from the values of quantity $K_{H1}$, the aperture dimensions $2\times_s$ and $2\times l_l$, the measured pressure $P_f$, the average pressure value $\overline{P}_{p1}$, the flow rate $Q_1$, and the determined value $\mu$ for viscosity of fluid in the formation in accordance with the relationships $$K_{H1} = \frac{4r_p[(P_{p1}^2 - P_f^2)/2P_{p1}]k_h}{Q_1\mu},$$

$$r_p = \sqrt{l_s^2/2 + l_l^2/2}.$$

35. The method of claim 20, wherein step g. comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(P_{p1}^2 - P_f^2)P_{p2}}{Q_2(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1 + \frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1 + \frac{K_{H1}^{3/2}l_l^3}{K_{V1}^{3/2}l_s^3} - \left(1 + \frac{K_{H1}l_l^2}{K_{V1}l_s^2}\right)^{3/2}\right]\right\},$$

$$\frac{K_{H1}}{M} = \frac{2}{\pi}\sqrt{\frac{1}{2}\left(1 + \frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1 + \frac{K_{H1}^{3/2}l_s^3}{K_{V1}^{3/2}l_l^3} - \left(1 + \frac{K_{H1}l_s^2}{K_{V1}l_l^2}\right)^{3/2}\right]\right\};$$

iii. determining a horizontal permeability value $k_h$ from the values of quantity $K_{H1}/M$, the aperture dimensions $2\times l_s$ and $2\times l_l$, the measured pressure $P_f$, the average pressure value $\overline{P}_{p2}$, the flow rate $Q_2$, and the determined value $\mu$ for viscosity of fluid in the formation in accordance with the relationships $$\frac{K_{H1}}{M} = \frac{4r_p[(P_{p2}^2 - P_f^2)/2P_{p2}]k_h}{Q_2\mu},$$

$$r_p = \sqrt{l_2^2/2 + l_l^2/2}.$$

36. The method of claim 20, wherein step g. comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(P_{p1}^2 - P_f^2)P_{p2}}{Q_2(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1+\frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3} - \left(1+\frac{K_{H1}l_l^2}{K_{V1}l_s^2}\right)^{3/2}\right]\right\},$$

$$\frac{K_{H1}}{M} = \frac{2}{\pi}\sqrt{\frac{1}{2}\left(1+\frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3} - \left(1+\frac{K_{H1}l_s^2}{K_{V1}l_l^2}\right)^{3/2}\right]\right\};$$

iii. determining a vertical permeability value $k_v$ from the value of a quantity $K_{Vi}$ comprising one of values $K_{V1}$ and $K_{V1}/M$, the aperture dimensions $2\times l_s$ and $2\times l_1$, the measured pressure $P_f$, a pressure value $\overline{P}_{pj}$ comprising one of the average pressure values $\overline{P}_{p1}$ and $\overline{P}_{p2}$, a flow rate $Q_n$ comprising one of the flow rates $Q_1$ and $Q_2$, and the determined value $\mu$ for viscosity of fluid in the formation in accordance with the relationships $$K_{Vi} = \frac{4r_p[(\overline{P}_{pj}^2 - P_f^2)/2\overline{P}_{pj}]k_v}{Q_n\mu},$$

$$r_p = \sqrt{l_s^2/2 + l_l^2/2}.$$

37. The method of claim 20, wherein step g. comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(\overline{P}_{p1}^2 - \overline{P}_f^2)P_{p2}}{Q_1(\overline{P}_{p2}^2 - \overline{P}_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\frac{1}{2}\left(1+\frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l} + \sinh^{-1}\frac{K_{H1}^{\frac{1}{2}}l_l}{K_{V1}^{\frac{1}{2}}l_s} + \frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3} - \left(1+\frac{K_{H1}l_l^2}{K_{V1}l_s^2}\right)^{3/2}\right]\right\},$$

$$\frac{K_{H1}}{M} = \frac{2}{\pi}\sqrt{\frac{1}{2}\left(1+\frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s} + \sinh^{-1}\frac{K_{H1}^{\frac{1}{2}}l_s}{K_{V1}^{\frac{1}{2}}l_l} + \frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3} - \left(1+\frac{K_{H1}l_s^2}{K_{V1}l_l^2}\right)^{3/2}\right]\right\};$$

iii. determining a vertical permeability value $k_v$ from the values of quantity $K_{V1}$, the aperture dimensions $2\times l_s$ and $2\times l_l$, the measured pressure $P_f$, the average pressure value $\overline{P}_{p1}$, the flow rate $Q_1$, and the determined value $\mu$ for viscosity of fluid in the formation in accordance with the relationships $$K_{V1} = \frac{4r_p[(\overline{P}_{p1}^2 - \overline{P}_f^2)/2P_{p1}]k_v}{Q_1\mu},$$

$$r_p = \sqrt{l_s^2/2 + l_l^2/2}.$$

38. The method of claim 20, wherein step g comprises the steps of:

i. calculating a measurement factor M from the measured pressure $P_f$, the average pressure values $\overline{P}_{p1}$ and $\overline{P}_{p2}$, and the flow rates $Q_1$ and $Q_2$ in accordance with the relationship $$M = \frac{Q_2(P_{p1}^2 - P_f^2)P_{p2}}{Q_2(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$ and $2\times l_l$ in accordance with the relationships $$K_{H1} = \frac{2}{\pi}\sqrt{\tfrac{1}{2}\left(1+\frac{l_s^2}{l_l^2}\right)}\left\{\frac{K_{H1}^{\frac{1}{2}}l_l}{K_{V1}^{\frac{1}{2}}l_s}\sinh^{-1}\frac{K_{V1}^{\frac{1}{2}}l_s}{K_{H1}^{\frac{1}{2}}l_l}+\sinh^{-1}\frac{K_{H1}^{\frac{1}{2}}l_l}{K_{V1}^{\frac{1}{2}}l_s}+\frac{K_{V1}^{\frac{1}{2}}l_s}{3K_{H1}^{\frac{1}{2}}l_l}\left[1+\frac{K_{H1}^{3/2}l_l^3}{K_{V1}^{3/2}l_s^3}-\left(1+\frac{K_{H1}l_l^2}{K_{V1}l_s^2}\right)^{3/2}\right]\right\},$$

$$\frac{K_{H1}}{M} = \frac{2}{\pi}\sqrt{\tfrac{1}{2}\left(1+\frac{l_l^2}{l_s^2}\right)}\left\{\frac{K_{H1}^{\frac{1}{2}}l_s}{K_{V1}^{\frac{1}{2}}l_l}\sinh^{-1}\frac{K_{V1}^{\frac{1}{2}}l_l}{K_{H1}^{\frac{1}{2}}l_s}+\sinh^{-1}\frac{K_{H1}^{\frac{1}{2}}l_s}{K_{V1}^{\frac{1}{2}}l_l}+\frac{K_{V1}^{\frac{1}{2}}l_l}{3K_{H1}^{\frac{1}{2}}l_s}\left[1+\frac{K_{H1}^{3/2}l_s^3}{K_{V1}^{3/2}l_l^3}-\left(1+\frac{K_{H1}l_s^2}{K_{V1}l_l^2}\right)^{3/2}\right]\right\};$$

iii. determining a vertical permeability value $k_v$ from the values of quantity $K_{V1}/M$, the aperture dimensions $2\times l_s$ and $2\times l_l$, the measured pressure $P_f$, the average pressure value $\overline{P}_{p2}$, the flow rate $Q_2$, and the determined value $\mu$ for viscosity of fluid in the formation in accordance with the relationships $$\frac{K_{V1}}{M} = \frac{4r_p[(\overline{P}_{p2}^2 - P_f^2)/2\overline{P}_{p2}]k_v}{Q_2\mu},$$

$$r_p = \sqrt{l_s^2/2 + l_l^2/2}\ .$$

39. A method of estimating permeability of an earth formation in at least one of the horizontal and vertical directions, the formation containing a formation fluid, comprising the steps of:

a. measuring a pressure $P_f$ of the formation fluid;

b. creating a pressure disturbance in the formation fluid by displacing fluid through a first probe aperture for a first time period at a first flow rate $Q_1$, the first probe aperture having a circular cross-section of radius $r_{p1}$;

c. measuring a pressure $P_{p1}$ of the fluid substantially at the end of the first time period;

d. creating a pressure disturbance in the formation fluid by displacing fluid through a second probe aperture for a second time period at a second rate $Q_2$, the second probe aperture having an elongate cross-section of width $2\times l_s$ and length $2\times l_l$;

e. measuring a pressure $P_{p2}$ of the fluid substantially at the end of the second time period;

f. determining a value $\mu$ for viscosity of fluid in the formation; and g. determining a value of permeability in at least one of the horizontal and vertical directions from the aperture dimensions $2\times l_s$, $2\times l_l$ and $r_{p1}$, the measured pressure $P_f$, at least one of the measured pressures $P_{p1}$ and $P_{p2}$, at least one of the flow rates $Q_1$ and $Q_2$, and the determined value $\mu$ for viscosity of fluid in the formation.

40. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{Hi}$ representative of the horizontal permeability of the formation and a value of a dimensionless quantity $K_V$ representative of the vertical permeability of the formation, based on the calculated measurement factor M and the aperture dimensions $2\times l_s$, $2\times l_l$ and $r_{p1}$; and iii. determining a horizontal permeability value $k_h$ from the values of quantity $K_{Hi}$; an aperture dimension $r_{pm}$ comprising one of values $r_{p1}$ and $r_{p2}$ where $r_{p2}$ is a function of $2\times l_s$ and $2\times l_l$; the measured pressure $P_f$; at least one of measured pressures $P_{p1}$ and $P_{p2}$; at least one of flow rates $Q_1$ and $Q_2$; and the determined value $\mu$ for viscosity of fluid in the formation.

41. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{H1}$ representative of the horizontal permeability of the formation and a value of a dimensionless quantity $K_V$ representative of the vertical permeability of the formation, based on the calculated measurement factor M and the aperture dimensions $2\times l_s$, $2\times l_l$ and $r_{p1}$; and iii. determining a horizontal permeability value $k_h$ from the values of quantity $K_{H1}$, the aperture dimension $r_{p1}$, the measured pressure $P_f$, the measured pressure $P_{p1}$, the flow rate $Q_1$, and the determined value $\mu$ for viscosity of fluid in the formation.

42. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_{H2}$ representative of the horizontal permeability of the formation and a value of a dimensionless quantity $K_V$ representative of the vertical permeability of the formation, based on the calculated measurement factor M and the aperture dimensions $2\times l_s$, $2\times l_l$ and $r_{p1}$; and iii. determining a horizontal permeability value $k_h$ from the values of quantity $K_{H2}$, the aperture dimensions $2\times l_s$ and $2\times l_l$, the measured pressure $P_f$, the measured pressure $P_{p2}$, the flow rate $Q_2$, and the determined value $\mu$ for viscosity of fluid in the formation.

43. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{Vi}$ representative of the vertical permeability of the formation, based on the calculated measurement factor M and the aperture dimensions $2\times l_s$, $2\times l_l$ and $r_{p1}$; and iii. determining a vertical permeability value $k_v$ from the values of quantity $K_{Vi}$; an aperture dimension $r_{pm}$ comprising one of values $r_{p1}$ and $r_{p2}$ where $r_{p2}$ is a function of $2\times l_s$ and $2\times l_l$; the measured pressure $P_f$; at least one of measured pressures $P_{p1}$ and $P_{p2}$; at least one of flow rates $Q_1$ and $Q_2$; and the determined value $\mu$ for viscosity of fluid in the formation.

44. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$; and iii. determining a vertical permeability value $k_v$ from the values of quantity $K_{V1}$, the aperture dimension $r_{p1}$, the measured pressure $P_f$, the measured pressure $P_{p1}$, the flow rate $Q_1$, and the determined value $\mu$ for viscosity of fluid in the formation.

45. The method of claim 39, wherein step g comprises the steps of:

i. calculating a measurement factor M from the measured pressures $P_f$, $P_{p1}$ and $P_{p2}$ and from the flow rates $Q_1$ and $Q_2$;

ii. determining a value of a dimensionless quantity $K_H$ representative of the horizontal permeability of the formation and a value of a dimensionless quantity $K_{V2}$ representative of the vertical permeability of the formation, based on the calculated measurement factor M and the aperture dimensions $2\times l_s$, $2\times l_l$ and $r_{p1}$; and iii. determining a vertical permeability value $k_v$ from the values of quantity $K_{V2}$, the aperture dimensions $l_s$ and $l_l$, the measured pressure $P_f$, the measured pressure $P_{p2}$, the flow rate $Q_2$, and the determined value $\mu$ for viscosity of fluid in the formation.

46. The method of claim 39, wherein step g comprises the steps of:

i. calculating a measurement factor m from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{2}{\pi} F\left(\frac{\pi}{2}, \sqrt{1 - \frac{K_{V1}}{K_{H1}}}\right)$$

-continued $$\frac{K_{H1}}{M} = \begin{cases} \dfrac{2r_{p2}}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_{p2}K_{H1}^{\frac{1}{2}}}{\pi l_l K_{V1}^{\frac{1}{2}}} F\left(\dfrac{\pi}{2}\left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

$$r_{p2} = \sqrt{l_s^2/2 + l_l^2/2};$$

where F denotes the complete elliptic integral of the first kind;

iii. determining a horizontal permeability value $k_h$ from the value of a quantity $K_{Hi}$ comprising one of quantities $K_{H1}$ and $K_{H1}/M$, a value $r_{pm}$ comprising one of values $r_{p1}$ and $r_{p2}$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationship $$K_{H1} = \frac{4r_{p1}(P_{pj} - P_f)k_h}{Q_n\mu}.$$

47. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_1$ and $r_{p1}$ in accordance with the relationships $$K_{H1} = \frac{2}{\pi} F\left(\frac{\pi}{2}, \sqrt{1 - \frac{K_{V1}}{K_{H1}}}\right)$$

$$\frac{K_{H1}}{M} = \begin{cases} \dfrac{2r_{p2}}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_{p2}K_{H1}^{\frac{1}{2}}}{\pi l_l K_{V1}^{\frac{1}{2}}} F\left(\dfrac{\pi}{2}\left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

-continued $$r_{p2} = \sqrt{l_s^2/2 + l_l^2/2}\ ;$$

where F denotes the complete elliptic integral of the first kind;

iii. determining a horizontal permeability value $k_h$ from the values of quantity $K_{H1}$, the aperture radius $r_{p1}$, the measured pressure $P_f$, the measured pressure $P_{p1}$, the flow rate $Q_1$, and the determined value $\mu$ for viscosity of fluid in the formation in accordance with the relationship $$K_{H1} = \frac{4r_{p1}(P_{p1} - P_f)k_h}{Q_1\mu}.$$

48. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)}\ ;$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \dfrac{2r_p}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_pK_{H1}^{\frac{1}{2}}}{\pi l_l K_{V1}^{\frac{1}{2}}} F\left(\dfrac{\pi}{2}, \left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

$$r_p = \sqrt{l_s^2/2 + l_l^2/2}\ ;$$

where F denotes the complete elliptic integral of the first kind;

iii. determining a horizontal permeability value $k_h$ from the values of quantity $K_{H1}/M$, the value $r_{p2}$, the measured pressure $P_f$, the measured pressure $P_{p2}$, the flow rate $Q_2$, and the determined value $\mu$ for viscosity of fluid in the formation in accordance with the relationship $$\frac{K_{H1}}{M} = \frac{4r_{p2}(P_{p2} - P_f)k_h}{Q_2\mu}.$$

49. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)}\ ;$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{2}{\pi} F\left(\frac{\pi}{2}, \sqrt{1 - \frac{K_{V1}}{K_{H1}}}\right)$$

$$\frac{K_{H1}}{M} = \begin{cases} \dfrac{2r_{p2}}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_{p2}K_{H1}^{\frac{1}{2}}}{\pi l_l K_{V1}^{\frac{1}{2}}} F\left(\dfrac{\pi}{2}\left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

$$r_{p2} = \sqrt{l_s^2/2 + l_l^2/2}\ ;$$

where F denotes the complete elliptic integral of the first kind;

iii. determining a vertical permeability value $k_v$ from the values of a quantity $K_{Vi}$ comprising one of the values $K_{V1}$ and $K_{V1}/M$, a value $r_{pm}$ comprising one of values $r_{p1}$ and $r_{p2}$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationship $$K_{V1} = \frac{4r_{pm}(P_{pj} - P_f)k_v}{Q_n\mu}.$$

50. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the value $K_{V1}$, the aperture radius $r_{p1}$, the measured pressure $P_f$, the measured pressure $P_{p1}$, the flow rate $Q_1$, and the determined value $\mu$ for viscosity of fluid in the formation in accordance with the relationship $$K_{V1} = \frac{4r_{p1}(P_{p1} - P_f)k_v}{Q_1\mu}.$$

51. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1} - P_f)}{Q_1(P_{p2} - P_f)};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the value $K_{V1}/M$, the value $r_{p2}$, the measured pressure $P_f$, the measured pressure $P_{p2}$, the flow rate $Q_2$, and the determined value $\mu$ for viscosity of fluid in the formation in accordance with the relationship $$\frac{K_{V1}}{M} = \frac{4r_{p2}(P_{p2} - P_f)k_v}{Q_2\mu}.$$

52. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}};$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $l_s$, $l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} =$$

-continued $$\begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2} \;;$$

where F denotes the complete elliptic integral of the first kind;

iii. determining a horizontal permeability value $k_h$ from the values of a quantity $K_{Hi}$ comprising one of quantities $K_{H1}$ and $K_{H1}/M$, a value $r_{pm}$ comprising one of values $r_{p1}$ and $r_{p2}$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationship $$K_{H1} = \frac{4r_{pm}[(P_{pj}^2 - P_f^2)/2P_{pj}]k_h}{Q_n \mu}.$$

53. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2 \times l_s$, $2 \times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

-continued $$r_p = \sqrt{l_s^2/2 + l_l^2/2} \;;$$

where F denotes the complete elliptic integral of the first kind;

iii. determining a horizontal permeability value $k_h$ from the values of quantity $K_{H1}$, the aperture radius $r_{p1}$, the measured pressure $P_f$, the measured pressure $P_{p1}$, the flow rate $Q_1$, and the determined value $\mu$ for viscosity of fluid in the formation in accordance with the relationship $$K_{H1} = \frac{4r_{p1}[P_{p1}^2 - P_f^2)/2P_{p1}]k_h}{Q_1 \mu}.$$

54. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2 \times l_s$, $2 \times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \dfrac{2r_p}{\pi l_s} F\left(\dfrac{\pi}{2}, \left(1 - \dfrac{K_{V1} l_l^2}{K_{H1} l_s^2}\right)^{\frac{1}{2}}\right) \text{for } \dfrac{K_{V1} l_l^2}{K_{H1} l_s^2} \leqq 1 \\ \dfrac{2r_p K_{H1}^{\frac{1}{2}}}{\pi l_l K_{V1}^{\frac{1}{2}}} F\left(\dfrac{\pi}{2}, \left(1 - \dfrac{K_{H1} l_s^2}{K_{V1} l_l^2}\right)^{\frac{1}{2}}\right) \text{for } \dfrac{K_{V1} l_l^2}{K_{H1} l_s^2} > 1, \end{cases}$$

$$r_p = \sqrt{l_s^2/2 + l_l^2/2} \;;$$

where F denotes the complete elliptic integral of the first kind;

iii. determining a horizontal permeability value $k_h$ from the values of quantity $K_{H1}/M$, the value $r_{p2}$, the measured pressure $P_f$, the measured pressure $P_{p2}$, the flow rate $Q_2$, and the determined value $\mu$ for viscosity of fluid in the formation in accordance with the relationship $$\frac{K_{H1}}{M} = \frac{4r_{p2}[(P_{p2}^2 - P_f^2)/2P_{p2}]k_h}{Q_2\mu}.$$

55. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \dfrac{2r_p}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_pK_{H1}^{\frac{1}{2}}}{\pi l_l K_{V1}^{\frac{1}{2}}} F\left(\dfrac{\pi}{2}, \left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the values of a quantity $K_{Vi}$ comprising one of the values $K_{V1}$ and $K_{V1}/M$, a value $r_{pm}$ comprising one of values $r_{p1}$ and $r_{p2}$, the measured pressure $P_f$, a measured pressure $P_{pj}$ comprising one of measured pressures $P_{p1}$ and $P_{p2}$, a flow rate $Q_n$ comprising one of flow rates $Q_1$ and $Q_2$, and the determined value $\mu$ for viscosity of fluid in the formation in accordance with the relationship $$K_{V1} = \frac{4r_{pm}[(P_{pj}^2 - P_f^2)/2P_{pj}]k_v}{Q_n\mu}.$$

56. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} = \begin{cases} \dfrac{2r_p}{\pi l_s} F\left(\dfrac{\pi}{2}, \left(1 - \dfrac{K_{V1}l_l^2}{K_{H1}l_s^2}\right)^{\frac{1}{2}}\right) \text{for } \dfrac{K_{V1}l_l^2}{K_{H1}l_s^2} \leqq 1 \\ \dfrac{2r_pK_{H1}^{\frac{1}{2}}}{\pi l_l K_{V1}^{\frac{1}{2}}} F\left(\dfrac{\pi}{2}, \left(1 - \dfrac{K_{H1}l_s^2}{K_{V1}l_l^2}\right)^{\frac{1}{2}}\right) \text{for } \dfrac{K_{V1}l_l^2}{K_{H1}l_s^2} > 1, \end{cases}$$

$$r_p = \sqrt{l_s^2/2 + l_l^2/2};$$

where F denotes the complete elliptic integral of the first kind;

iii. determining a vertical permeability value $k_v$ from the value $K_{V1}$, the aperture radius $r_{p1}$, the measured pressure $P_f$, the measured pressure $P_{p1}$, the flow rate $Q_1$, and the determined value $\mu$ for viscosity of fluid in the formation in accordance with the relationship $$K_{V1} = \frac{4r_{p1}[(P_{p1}^2 - P_f^2)/2P_{p1}]k_v}{Q_1\mu}.$$

57. The method of claim 39, wherein step g comprises the steps of:

i. calculating a measurement factor M from the measured pressures $P_f$, $P_{p1}$ and $P_{p2}$ and from the flow rates $Q_1$ and $Q_2$ in accordance with the relationship $$M = \frac{Q_2(P_{p1}^2 - P_f^2)P_{p2}}{Q_1(P_{p2}^2 - P_f^2)P_{p1}}.$$

ii. determining a value of a dimensionless quantity $K_{H1}$ representative of the horizontal permeability of the formation and a value of a dimensionless quantity $K_{V1}$ representative of the vertical permeability of the formation, based on the calculated measurement factor M and the aperture dimensions $2\times l_s$, $2\times l_l$ and $r_{p1}$ in accordance with the relationships $$K_{H1} = \frac{\pi}{2} F\left(\frac{\pi}{2}, \sqrt{1 - \frac{K_{V1}}{K_{H1}}}\right)$$

$$\frac{K_{H1}}{M} =$$

-continued $$\begin{cases} \frac{2r_p}{\pi l_s} F\left(\frac{\pi}{2}, \left(1 - \frac{K_{V1} l_l^2}{K_{H1} l_s^2}\right)^{\frac{1}{2}}\right) \text{for } \frac{K_{V1} l_l^2}{K_{H1} l_s^2} \leqq 1 \\ \frac{2r_p K_{H1}^{\frac{1}{2}}}{\pi l_l K_{V1}^{\frac{1}{2}}} F\left(\frac{\pi}{2}, \left(1 - \frac{K_{H1} l_s^2}{K_{V1} l_l^2}\right)^{\frac{1}{2}}\right) \text{for } \frac{K_{V1} l_l^2}{K_{H1} l_s^2} > 1, \end{cases}$$

$$r_p = \sqrt{l_s^2/2 + l_l^2/2} \;;$$

where F denotes the complete elliptic integral of the first kind;

iii. determining a vertical permeability value $k_v$ from the value $K_{V1}/M$, the value $r_{p2}$, the measured pressure $P_f$, the measured pressure $P_{p2}$, the flow rate $Q_2$, and the determined value $\mu$ for viscosity of fluid in the formation in accordance with the relationship $$\frac{K_{V1}}{M} = \frac{4r_{p2}[(P_{p2}^2 - P_f^2)/2P_{p2}]k_v}{Q_2\mu}.$$

* * * * *